US006726958B2

(12) United States Patent
Kawabe

(10) Patent No.: US 6,726,958 B2
(45) Date of Patent: Apr. 27, 2004

(54) COATING METHOD WITH SELECT PARAMETERS

(75) Inventor: Shigetoshi Kawabe, Hino (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 10/178,665

(22) Filed: Jun. 24, 2002

(65) Prior Publication Data

US 2003/0140849 A1 Jul. 31, 2003

(30) Foreign Application Priority Data

Jun. 28, 2001 (JP) ..... 2001-196344

(51) Int. Cl.[7] ..... B05D 1/26; B05D 1/34

(52) U.S. Cl. ..... 427/356; 427/402; 118/410; 118/411

(58) Field of Search ..... 427/356, 358, 427/402; 118/410, 411

(56) References Cited

U.S. PATENT DOCUMENTS 5,324,357 A * 6/1994 Okuno et al. ..... 118/411
5,759,627 A * 6/1998 Kokubo et al. ..... 427/356
6,214,114 B1 * 4/2001 Kawabe et al. ..... 118/325
6,436,190 B1 * 8/2002 Akagi ..... 118/419

FOREIGN PATENT DOCUMENTS

JP 2000-262947 * 9/2000

* cited by examiner

*Primary Examiner*—Katherine A. Bareford
(74) *Attorney, Agent, or Firm*—Muserlian, Lucas and Mercanti

(57) ABSTRACT

A coater comprises upstream and down stream side bars between which a pocket and a slit are formed. The coating apparatus satisfies the following conditional formula:

$$6(t_1^{-3}+t_2^{-3})\mu\times hw\times u\times Ls(Ls/2+Lp)L^3/(h^4E)\leqq\Delta hd_{max}/hd$$

where Ls is a length (mm) of the slit, h is a gap (mm) of the slit, Lp is a length (mm) of a cross section of the pocket, L=Ls+Lp, E is a Young's modulus (Pa) of the upstream and downstream bars, t1 and t2 are a thickness (mm) of the thinnest portion of the upstream and downstream side bars at the pocket, $\mu$ is a viscosity (Pa·s), u is a coating speed (mm/s), and $\Delta hd_{max}$ is a permissible maximum value (mm) among differences Δhd (mm) between the maximum value and the minimum value in the dispersion of a dried layer thickness hd.

8 Claims, 5 Drawing Sheets

COATING METHOD WITH SELECT PARAMETERS

BACKGROUND OF THE INVENTION

The present invention relates to a coating method, as well as a coating apparatus, which applies a coating liquid onto a continuously moving belt-shaped support (web-shaped support), and more specifically to a coating apparatus as well as a coating method which minimizes fluctuation of lateral coating thickness.

Conventionally known as methods to apply a coating liquid onto a continuously moving belt-shaped support have been a dip coating method, a blade coating method, an air knife coating method, a wire bar coating method, a gravure coating method, a reverse coating method, a reverse roller coating method, an extrusion coating method, a slide coating method, and a curtain coating method. Further, in these coating methods, the coating has been attentively carried out while paying special attention to the size as well as the accuracy of coating apparatuses so as to obtain a uniform dried lateral thickness of the coating.

Incidentally, the coating apparatus, as described in the present invention, refers to a coater and more specifically refers to a coater which comprises a pocket which uniformly supplies a supplied coating liquid in the lateral coating direction and a slit which uniformly extrudes the coating liquid which has been supplied to said pocket. Listed as such coaters are, for example, an extrusion coater, a slide coater and a curtain coater.

Of these coating methods, in the case of the extrusion coating method, two methods have been known. One, namely, is a method in which coating is carried out while a belt-shaped support, at the initiation of coating, is supported by a back roller, and the other is one in which coating is carried out while said belt-shaped support is not supported.

In regard to the extrusion coating method in which coating is carried out while a belt-shaped support, at the initiation of coating, is supported by a back roller, many patents have been applied for coating systems as well as coating apparatuses, such as Japanese Patent Publication Open to Public Inspection Nos. 56-95363 and 50-142643 which disclose single layer coating methods, as well as Japanese Patent Publication Open to Public Inspection Nos. 45-12390 and 46-236 which disclose multilayer coating systems. In these coating methods, coating is carried out in such a manner that the gap between the coater and the belt-shaped support supported by the back roller is commonly maintained to be less than or equal to 1 mm. Further, atmospheric pressure may be reduced upstream as disclosed in U.S. Pat. No. 2,681,294.

When coating is carried out employing a belt-shaped support, as a method to minimize fluctuation of lateral coating thickness, it has heretofore been carried out to mechanically adjust the lateral gap between the coater and the belt-shaped support. Further, recently, Japanese Patent Publication Open to Public Inspection No. 8-215631 discloses a technique in which a mechanism, which adjusts the gap between the coater and the belt-shaped support, is allowed to move in the lateral direction so that said gap can be adjusted at an optional position.

In regard to the extrusion coating method in which coating is carried out while the belt-shaped support, at the initiation of coating, is not supported by the back roller, many patents have been applied for coating systems as well as coating apparatuses, such as Japanese Patent Publication Open to Public Inspection Nos. 50-138036, 55-165172, and 1-288364 which disclose single layer coating methods, as well as Japanese Patent Publication Open to Public Inspection Nos. 2-251265, 2-258862, and 5-192627 which disclose multilayer coating systems.

In these coating methods, coating is carried out in such manner that the coating liquid outlet of the coater is brought into direct contact with a moving belt-shaped support in the free span between support rollers, which do not support said moving support.

In said methods, fluctuation of the lateral coating thickness on said belt-shaped support has been minimized as follows. Heretofore, as disclosed in Japanese Patent Publication Open to Public Inspection No. 2-207866, the degree of the lateral right angle of the edge of the coating liquid outlet of the coater is enhanced. Further, as disclosed in Japanese Patent Publication Open to Public Inspection Nos. 9-141173 and 11-60006, are methods recently employed in which a pressing member, which presses a belt-shaped support in the specified direction, is installed near the extrusion coater so that even though said belt-shaped support exhibits some distortion in the lateral direction, fluctuation of coating thickness as well as non-coating is minimized.

In the prior art, no disclosure has been made for how a coater itself is designed so as to match products to be coated. Further, the desired accuracy to coat said products has also not been disclosed.

As a result, when a prepared coater results in an insufficient uniformity of lateral coating thickness upon coating a coating liquid, coating is carried out while making trial and error operations such as mechanical adjustment of the gap, as well as a survey for coating conditions so that the desired uniform thickness is achieved. However, a large and expensive equipment is required to make it possible to perform such operations. In addition, it requires difficult adjustment operations and it is difficult to accurately adjust said gap to the desired spacing. Accordingly, when coating is carried out employing a coater comprising a pocket as well as a slit, it is demanded to develop a coating apparatus as well as a coating method which minimizes fluctuation in lateral coating thickness as well as satisfies coating conditions while being independent of trial and error operations, such as mechanical adjustment of the slit distance as well as alteration of coating conditions.

SUMMARY OF THE INVENTION

From the viewpoint of the foregoing, the present invention was achieved.

An object of the present invention is to provide an optimal coating apparatus as well as an optimal coating method which matches the physical properties of a coating fluid as well as coating conditions in order to minimize fluctuation in the lateral coating thickness in coatings which employ a coater comprising a pocket as well as a slit.

Embodiments to achieve the aforesaid object of the present invention will now be described.

1. In a coating apparatus, comprising at least one set of a slit and a pocket, which applies at least one layer comprising a coating liquid having a viscosity of $\mu$ (in Pa·s) onto a belt-shaped support (web-shaped support) at a coating rate (coating speed) of u (in mm/s) so as to obtain a pre-drying coating thickness (wet coating layer thickness) of hw (in mm), a coating apparatus wherein either slit length Ls (in mm) or slit gap h (in mm) is set so as to satisfy the relationship of:

$$1\times10^4<12\times\mu\times Ls\times hw\times u/h^3\leqq4\times10^5.$$

2. In a coating method, employing a coating apparatus, provided with at least one set of a slit having a length of Ls (in mm) and a slit having a gap of h (in mm), which applies at least one layer onto a belt-shaped support at a coating rate of u (in mm/s), a coating method wherein coating liquid viscosity $\mu$ (in Pa·s) and pre-drying coating thickness hw (in mm) are adjusted to satisfy the relationship of:

$$1\times10^4<12\times\mu\times Ls\times hw\times u/h^3\leqq4\times10^5.$$

3. In a coating method, employing a coating apparatus, provided with at least one set of a slit having a length of Ls (in mm) and a slit having a gap of h (in mm), which applies at least one layer comprised of a coating liquid of a viscosity of $\mu$ (in Pa·s) onto a belt-shaped support so as to obtain a pre-drying coating thickness of hw (in mm), a coating method wherein coating is carried out by adjusting the coating rate to u (in mm/s) so as to satisfy the relationship of:

$$1\times10^4<12\times\mu\times Ls\times hw\times u/h^3\leqq4\times10^5.$$

4. In a coating apparatus, which is provided with at least one set of a slit and a pocket, and employed to apply at least a single coating layer onto a belt-shaped support, a coating apparatus wherein when $\Delta hd_{max}$ (in mm) represents the permissible maximum value of difference Δhd (in mm) between the maximum value and the minimum value of fluctuation (dispersion) of the lateral coating thickness (dried coating layer thickness) hd (in mm), and Δh (in mm) represents the difference between the maximum value and the minimum value of fluctuation of slit gap h (in mm), Δh (in mm) is set based on the magnitude of $\Delta hd_{max}$ (in mm) so as to satisfy the relationship of:

$$\Delta h\leqq h\times(\Delta hd_{max}/hd)/3.$$

5. In a coating apparatus, which is provided with at least one set of a slit and a pocket, and is employed to applies at least one coating layer onto a belt-shaped support, a coating apparatus wherein when Ls (in mm) represents the length of a slit, h (in mm) represents the gap of a slit, X (in mm) represents the farthest distance of the lateral coating from the coating liquid supply outlet section, and $\Delta hd_{max}$ (in mm) represents the permissible maximum value of difference Δhd (in mm) between the maximum value and the minimum value of fluctuation of the lateral coating thickness hd (in mm), the relationship described below is satisfied:

$$(X^2/R^4)/(Ls/h^3)<18\times(\Delta hd_{max}/hd).$$

6. In a coating apparatus which is provided with at least one set of a slit and a pocket, and is employed to apply a coating liquid having a viscosity of $\mu$ (in Pa·s) onto a belt-shaped support at a coating rate of u (in mm/s) so as to obtain a pre-drying coating thickness of hw (in mm), a coating apparatus wherein when Ls (in mm) represents the length of said slit, Lp (in mm) represents the length of the cross-section of said pocket along the slit length, L (in mm) represents the sum of Ls (in mm) and Lp (in mm), E (in Pa) represents the Young's modulus of a coater member, $t_1$ (in mm) represents the thickness of the thinnest portion of said pocket of a bar on the upstream side, $t_2$ (in mm) represents the thickness of the thinnest portion of the pocket of the bar on the downstream side, hd (in mm) represents the coating thickness after drying, and $\Delta hd_{max}$ (in mm) represents the permissible maximum value of difference Δhd (in mm) between the maximum value and the minimum value of fluctuation of the lateral post-drying coating thickness (dried coating layer thickness) hd (in mm), the relationship described below is satisfied:

$$6(t_1^{-3}+t_2^{-3})\mu\times hw\times u\times Ls(Ls/2+Lp)L^3/(h^4E)\leqq\Delta hd_{max}/hd.$$

7. In a multilayer coating apparatus which is provided with at least two sets of a slit and a pocket, and is employed to apply at least two layers of coating liquid onto a belt-shaped support at a coating rate of u (in mm/s), wherein when $L_s$ (in mm) represents the length of said slit, and $Ls_1, Ls_2, \ldots, Ls_{i-1}, Ls_i, Ls_{i+1} \ldots, Ls_n$ represent the length of each slit in sequential order of the layers on the upstream side; Lp (in mm) represents the length of said slit of the cross-sectional length and $Lp_1, Lp_2, \ldots, Lp_{i-1}, Lp_i, Lp_{i+1}, \ldots, Lp_n$ represent said length of each slit in sequential order on the upstream side; L represent the sum of L and Lp and $L_1, L_2, \ldots, L_{i-1}, L_i, L_{i+1} \ldots, L_n$ represents each said sum from the upstream side; E (in Pa) represents Young's modulus of a coater member; t (in mm) represents the thickness of the thinnest portion of said pocket section of each bar and $t_1, t_2, t_3, \ldots, t_{i-1}, t_i, t_{i+1} \ldots, t_n$ represents the thinnest portion of said thickness in sequential order from the block upstream; $\mu$ (in Pa·s) represents the viscosity of the coating liquid, $\mu_i$ (in Pa·s) represents the viscosity in the order i coating liquid from upstream; hw (in mm) represents the pre-drying coating thickness and $hw_i$ (in mm) represents the pre-drying coating thickness of the order i coating layer from upstream; hd (in mm) represents the post-drying coating thickness and $hd_i$ (in mm) represents the post-drying coating thickness if the order i coating layer from upstream; $\Delta hd_{max}$ (in mm) represents the permissible maximum value of difference between the maximum value and the minimum value of fluctuation of the post-drying coating thickness, and $\Delta hd_{maxi}$ (in mm) represents said value in the order i coating layer from upstream; and a coating apparatus wherein the relationship described below is satisfied: h (in mm) represents the gap of said slit and hi (in mm) represents the gap in the order of i slit from upstream, the relationship described below is satisfied:

$$\begin{aligned}&6(t_i^{-3}+t_{i+1}^{-3})\mu_i\\&\times hw_i\times u\times L_{si}\\&(L_{si}/2+Lp_i)\\&L_i^3/h_i^3-6t_i^{-3}\\&\times\mu_{i-1}\times hw_{i-1}\times u\times Ls_{i-1}\\&(Ls_{i-1}/2+Lp_{i-1})\\&L_{i-1}^3/h_{i-1}^3-6\\&t_{i+1}^{-3}\times\mu_{i+1}\times\\&hw_{i+1}\times u\times Ls_{i+1}(Ls_{i+1}/2+Lp_{i+1})\\&L_{i+1}^3/h_{i+1}^3\leqq h_i\\&(\Delta hd_{maxi}/hd_i)E\end{aligned}$$

8. A coating method wherein at least two coating layers are applied onto a belt-shaped support at a coating rate of u (in mm/s), employing the coating apparatus described in 7.

9. The coating apparatus, described in any one of 1. and 4. through 7., wherein the surface opposite the coating surface of a belt-shaped support at the coater section is supported by a back roller.
10. The coating method, described in any one of 2., 3., and 8., wherein the surface opposite the coated surface of a belt-shaped support at the coater section is supported by a back roller.

The inventors of the present invention diligently conducted investigations to overcome the aforesaid problems. As a result, it was discovered that when coating was carried out employing a coater comprising a pocket as well as a slit, it became difficult to assure a definite flow rate of coating liquid across the coating width, due to pressure loss of the coating liquid in the coater from the time when said coating liquid was supplied into said pocket under a definite pressure to the time when said coating liquid flowed out from the slit, as well as the distortion of the slit gap due to the pressure of the supplied coating liquid. Further, it was also discovered that when a coating liquid of high viscosity was coated, said tendency was further pronounced.

Specifically, it was found that it was difficult to stabilize the lateral coating thickness of a high viscosity coating liquid only by individually adjusting coating conditions and coater conditions, and it was critical to conduct investigations for physical properties of coating liquid to be coated, as well as coating conditions (coating thickness as well as coating rate), and in addition, to conduct investigation of the slit of the employed coater and the pocket size. In order to realize these discoveries, investigations were conducted in which the general formula of fluid dynamics in regard to the fluid resistance of the fluid which flows between two flat plates. As a result, it was discovered that the lateral coating thickness was stabilized utilizing the optimal relational expression as well as optimal coefficients for the coating liquid and the coater, whereby the present invention was achieved.

In the invention, it may be preferable that the viscosity of the coating liquid is 0.05 to 10 (Pa·s), more preferably, the viscosity of the coating liquid is 0.1 to 5 (Pa·s). Further, it may be preferable that a coating width of the slit is 1000 mm to 1500 mm.

DETAILED DESCRIPTION OF THE PREFERRED EMBODIMENTS

One example of the embodiment according to the present invention is described employing an extrusion coater based on FIGS. 1 through 5. However, the present invention is not limited to the embodiment.

Figure 1:
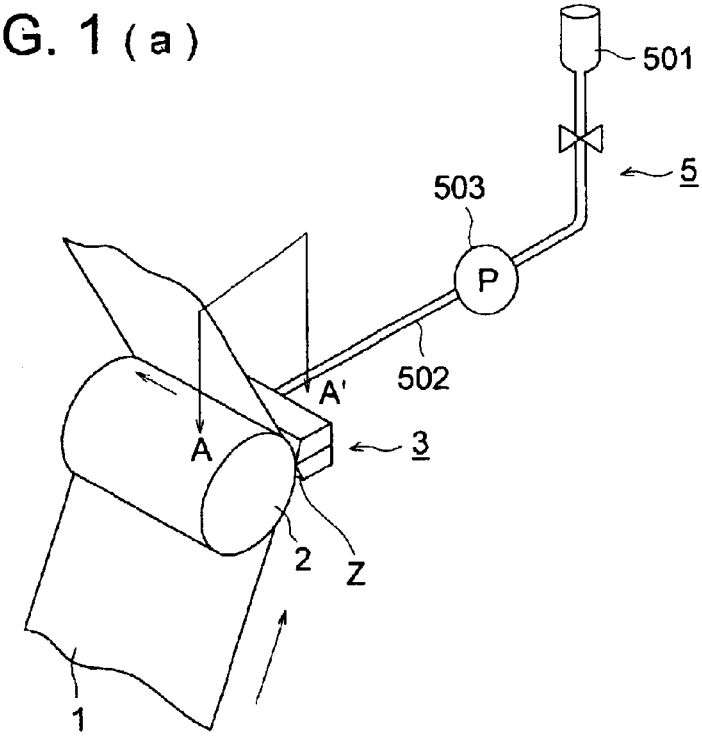
FIGS. 1(*a*) and 1(*b*) each is a schematic view showing a coating system employing an extrusion coater.
Figure 1:
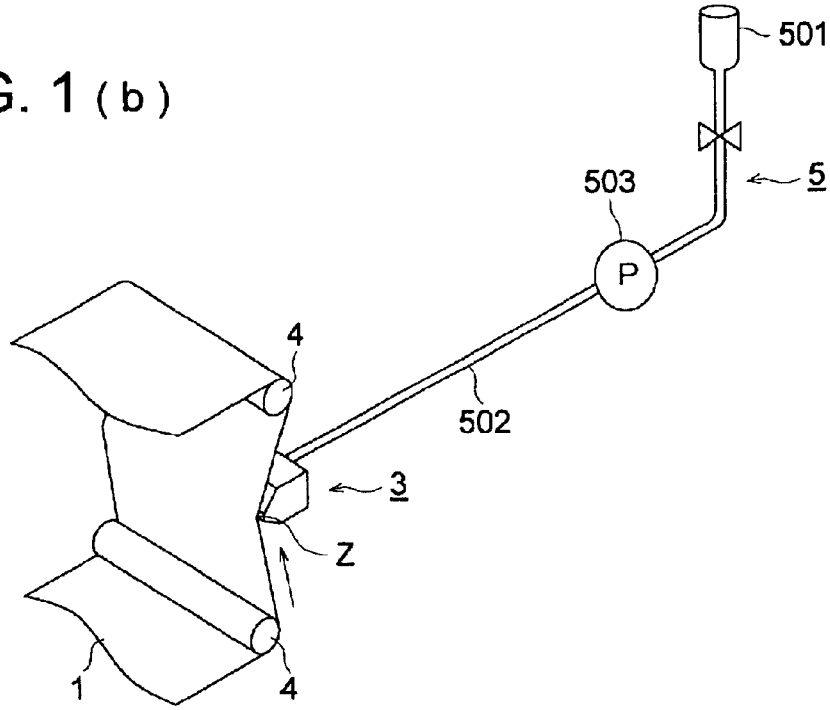

FIGS. 1(*a*) and 1(*b*) each is a schematic coating view showing a coating system which employs an extrusion coater. FIG. 1(*a*) is a schematic coating view showing a coating system in which an extrusion coater is employed at a supported section of a belt-shaped support of which surface opposite the surface to be coated is supported by a back roller. FIG. 1(*b*) is a schematic coating view showing a coating system in which coating is carried out employing an extrusion coater for a belt-shaped support of which surface opposite to the surface to be coated is not supported by a back roller. In FIG. 1, numeral 1 shows a belt-shaped support which continually moves from upstream to downstream (In FIG. 1, from the lower level to the upper level), as shown by the arrow. Numeral 2 shows a back roller and numeral 3 shows an extrusion coater for coating a single layer. Z shows a coating starting point at which a coating liquid, which is extruded from extrusion coater 3, and numeral 4 shows said support roller.

Numeral 5 shows a supply section which supplies said coating liquid to extrusion coater 3; numeral 501 shows a supply tank of said coating liquid; numeral 502 is a pipe system, and numeral 503 is a supply pump. Said supply tank as well as said pipe system may occasionally be subjected to a water-repellent finishing process such as a fluorine treatment. Extrusion coater 3 is of a so-called pre-weighing type in which a coating thickness is determined based on the supply amount of said coating liquid. Therefore, high accuracy is required for the supply of said coating liquid. In order to minimize flow rate variation, preferably employed as said supply pumps are, high precision liquid transport pumps such as precision weighing type gear pumps and plunger pumps, as well as flow rate controls. If desired, in said supplied section, valves at several positions of said pipe system, an exit for waste liquid, filters, a flow meter, a debubbler, a heat exchanger, and a stirrer are preferably employed in combination.

The coating system shown in FIG. 1(*a*), is known as one which tends to result in uniform coating thickness due to the fact that the flatness of a belt-shaped support is maintained by back roller 2 opposite the surface of belt-shaped support 1 to be coated. Back roller 2, as described herein, refers to the transport roller which is installed on the side opposite the coating side of belt-shaped support 1 so that said belt-shaped support 1 is placed between said extrusion coater and said back roller 2. Cylindricity greatly affects the accuracy of the lateral coating gap between the extrusion coater and the belt-shaped support. As a result, said support roller is comprised of metal having a large diameter such as more than or equal to 200 mm.

The support roller, as described herein, refers to each of two transport rollers which are installed at positions prior to and after the coater so as to face the surface opposite the coating surface of a belt-shaped support to maintain the flatness of said belt-shaped support, while coating is carried out employing an extrusion coating system onto said belt-shaped support opposite the coating surface which is not supported by a back roller. Incidentally, the support roller, which is positioned upstream in the transport direction seen from the coater, may be positioned on the coating surface side.

Figure 2:
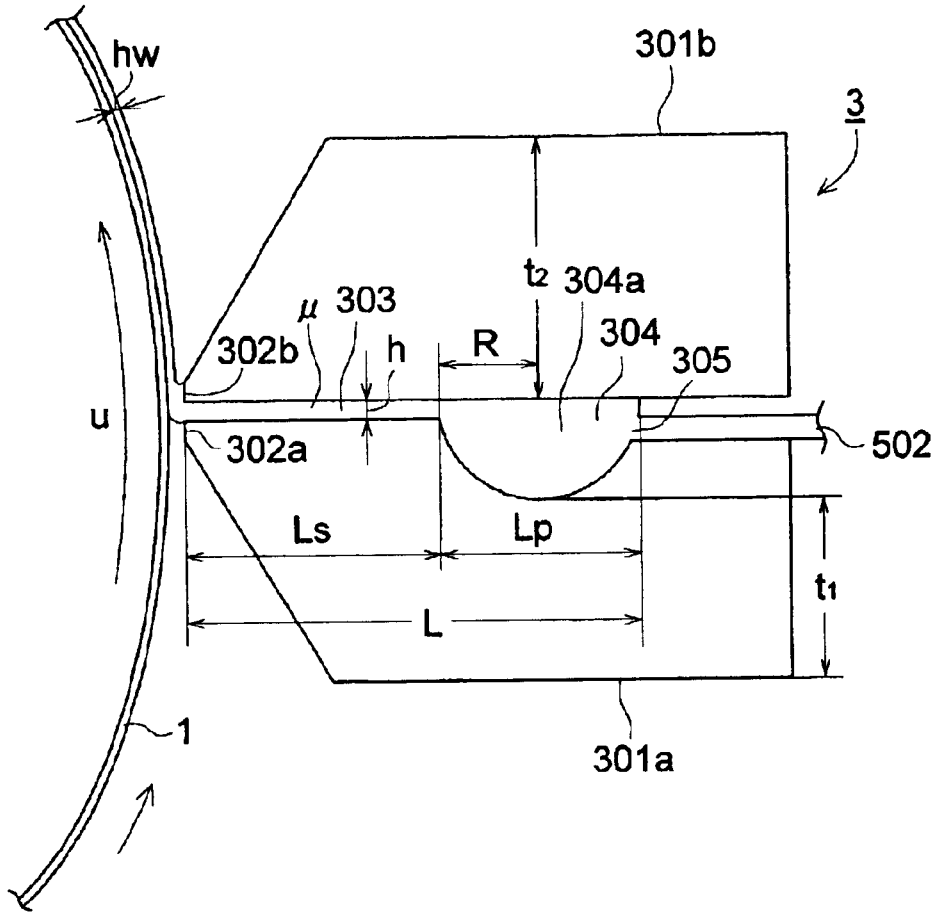
FIG. 2 is an enlarged cross-sectional schematic view along A–A' in (*a*) of FIG. 1.

FIG. 2 is an enlarged cross-sectional schematic view along A–A' in FIG. 1(*a*). In FIG. 2, numeral 301*a* shows the upstream bar constituting extrusion coater 3, while numeral 301*b* shows the downstream bar constituting extrusion coater 3. Extrusion coater 3 is a single layer coater in which said bars are fixed employing bolts (not shown). Numerals 302*a* and 302*b* each shows a lip at the tip of each bar. Numeral 303 shows a slit between the flat surfaces of said bars.

Numeral 304 shows the extended pocket section which is extendedly provided in the lateral direction of extrusion coater 3. Pocket section 304 is provided between upstream bar 301*a* and downstream bar 301*b*. Said pocket section is nearly semicircular, while being provided with a groove-shaped pocket in upstream bar 301*a* and a flat surface in downstream bar 301*b*. In the present invention, the shape of said pocket section is semicircular. However, said shape may be a circle formed by two bars which are provided with a pocket, or may be rectangular or elliptical.

Numeral 305 shows a coating liquid supply port installed in pocket 304*a*. Symbol hw represents the pre-drying coating thickness (in mm) of a coating which has been extruded and applied onto belt-shaped support 1 from the lip through the slit, after a coating liquid, which has been supplied to the lateral center of the pocket or an optional position from a coating liquid supply port installed in a pocket, was spread in the lateral coating direction.

Symbol $\mu$ represents the viscosity (in Pa·s) of a coating liquid which flows through the slit; Ls represents the slit length (in mm), Lp represents the length (in mm) of the cross-section of the pocket section along the slit; L represents the sum (in mm) of slit length Ls and length Lp of the cross-section of the pocket along the slit; h represents the slit gap (in mm); $t_1$ represents the thickness (in mm) of the thinnest portion of the pocket section of the bar on the downstream side; $t_2$ represents the thickness (in mm) of the thinnest portion of the pocket section of the bar on the upstream side; R represents the equivalent radius (in mm) of the pocket section; and u represents the coating rate (in mm/s). The equivalent radius R (in mm), as described herein, refers to the value obtained by (½×cross-sectional area/peripheral length of the cross-section) when the cross-section is not circular.

Incidentally, in the present invention, all of viscosity $\mu$ (in Pa·s) of the coating liquid, slit length Ls (in mm), length Lp (in mm) of the cross-section of the pocket along the slit, slit gap h (in mm), thickness $t_1$ (in mm) of the thinnest portion at the position in which the pocket is installed at the bar on the upstream side, thickness $t_2$ (in mm) of the thinnest portion of the pocket section of the bar on the downstream side, equivalent radius R (in mm) of the pocket, pre-drying coating thickness hw (in mm), and coating rate u (in mm/s) represent the average of each value.

Figure 3:
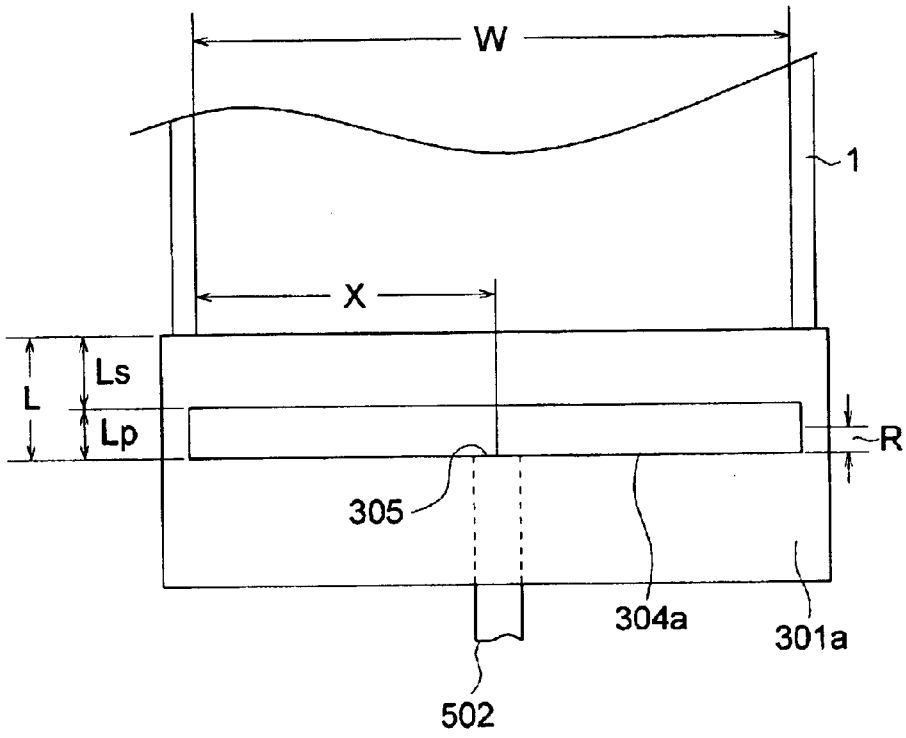
FIG. 3 is a schematic top view of bar 301*a* on the upstream side of extrusion coater 3 shown in FIG. 2.

FIG. 3 is a schematic top view of bar 301*a* on the upstream side of extrusion coater 3 shown in FIG. 2. Incidentally, in FIG. 3, in order to describe the relationship between the coating width and the coating liquid supply port, bar 301*b* on the downstream side is not shown.

In FIG. 3, W represents the coating width (in mm), and X represents the distance from the center of coating liquid supply port of the pocket to the limit of the coating width. Other numerals are the same as defined in FIG. 2.

When coating is carried out employing extrusion coater 3 for single layer coating shown in FIGS. 2 and 3, each formula of slit resistance, slit gap and coating liquid viscosity with the stability of coating thickness will now be described.

When coating is carried out employing either of the extrusion coaters for single layer coating shown in FIGS. 2 and 3, when the coating liquid flows through the slit, slit pressure loss ΔPs (in Pa) is generated.

The slit pressure loss ΔPs (in Pa) shows the pressure at the coating liquid inlet section of the slit, namely the pocket pressure. The inventor of the present invention conducted investigations on the range of slit pressure loss ΔPs (in Pa) in order to obtain excellent uniform coating thickness. As a result, it was discovered that the range of the slit pressure loss ΔPs (in Pa) was $1\times10^4<\Delta Ps\leqq4\times10^5$.

When ΔPs exceeds $4\times10^5$, coating liquid supply is subjected to resistance resulting in fluctuations in the supply flow rate. As a result, uniform coating thickness, in the transport direction of the belt-shaped support, is degraded. In addition, when the rigidity of members, which constitute the extrusion coater, is low, the extrusion coater is subject to distortion resulting in a non-uniform slit gap, whereby the uniform thickness in the lateral direction of the coating is markedly degraded.

When ΔPs is less than $1\times10^4$, the flow through the slit results in no resistance. As a result, before a coating liquid is uniformly spread over the lateral direction of the coating, said coating liquid flows out from the slit section near the coating liquid supply port, whereby it becomes impossible to obtain a uniform coating thickness.

As a result that the inventor studied factors and relations having a influence for the slit pressure loss ΔPs, the inventors found that the slit pressure loss ΔPs is obtained based on Formula (1).

$$\Delta Ps=12\times\mu\times Ls\times hw\times u/h^3 \qquad \text{Formula (1)}$$

Incidentally, coating liquid viscosity $\mu$ (in Pa·s), employed herein, refers the viscosity of a coating liquid which flows in the slit. When Us represents the average flow rate (mm/s) through the slit and h represents the slit gap (in mm), the viscosity of the coating liquid at shearing rate γs in the slit, which is approximately calculated employing Formula (2), is employed.

$$\gamma s=4\times Us/h \qquad \text{Formula (2)}$$

wherein Us represents the average flow rate (in mm/s) in the slit which is obtained by Formula (3).

$$Us(\text{in mm/s})=\text{coating liquid supply rate}/(h\times W)=hw\times u/h \qquad \text{Formula (3)}$$

wherein coating liquid supply rate (in $mm^3/s$) is obtained by Formula (4).

$$\text{Coating liquid supply rate (in mm}^3\text{/s)}=W\times hw\times u \qquad \text{Formula (4)}$$

Methods to satisfy the relationship of $1\times10^4<\Delta Ps\leqq4\times10^5$ are as follows. One method is one in which a coating apparatus is employed in which coater slit length Ls (in mm) as well as the slit gap h is set so as to match the coating liquid and coating conditions. In another method, coating may be carried out by adjusting coating liquid viscosity $\mu$ (in Pa·S), pre-drying coating thickness hw (in mm), through altering solid concentration, as well as the kind of solvents, or by adjusting the coating rate (in mm/s).

When coating is carried out employing the extrusion coater for single layer coating shown in FIGS. 2 and 3, effects of the slit gap accuracy on the stability of coating thickness will now be described. Since, in the aforesaid Formula (1), hw×u represents the coating liquid flow rate per unit width, based on this formula, it is derived that the flow rate is proportional with the cube of gap h, namely $h^3$.

Accordingly, when Q (in $mm^3/s$) represents the flow rate per unit width, ΔQ ($mm^3/s$) represents the difference between the maximum value and the minimum value of its fluctuation in the lateral direction of the coating, and Δh (in mm) represents the difference between the maximum value and the minimum value of the fluctuation in slit width h (in mm), since it is considered that variation ratio {(Q+ΔQ)/Q} of flow rate Q becomes equal to the cube of variation ratio {(h+Δh)/h} of slit gap h (in mm) along the lateral coating width, the inventors made Formulas (5) and (6) described below:

$$\{(Q+\Delta Q)/Q\}=\{(h+\Delta h)/h\}^3\approx 1+3\times\Delta h/h \quad \text{Formula (5)}$$

$$\Delta Q/Q\approx 3\times\Delta h/h \quad \text{Formula (6)}$$

On the other hand, as a result that the inventors studied the influence of the dispersion (distribution) in flow amount (the coating liquid flow rate) along the coating width (the lateral coating direction) for the dispersion (distribution) in the pre-dried coating layer thickness along the coating width, the inventors found that the dispersion in the coating liquid flow rate is a main cause of the dispersion in the coating layer thickness along the coating width. Then, the inventor found the following relationship: that is, the coating liquid flow rate distribution expressed by a ratio (ΔQ/Q) with respect to average flow rate Q of difference ΔQ between the maximum value and the minimum value of the fluctuation in the flow rate in the lateral coating direction can be approximated by Formula (7), without any modification, as the coating thickness distribution expressed by the ratio (Δhw/hw) with respect to the average pre-drying coating thickness hw of the average of difference ≈hw between the maximum value and the minimum value of the fluctuation in the lateral pre-drying coating thickness.

$$\Delta hw/hw\approx\Delta Q/Q \quad \text{Formula (7)}$$

Formula (8) is derived from the aforesaid Formulas (6) and (7).

$$\Delta hw/hw\approx 3\times\Delta h/h \quad \text{Formula (8)}$$

When Δhw represent permissible maximum value $\Delta hw_{max}$ of the difference between the maximum value and the minimum value of the fluctuation of the lateral pre-drying coating thickness, Formula (8) can be expressed by Formula (9).

$$\Delta hw_{max}/hw\geqq 3\times\Delta h/h \quad \text{Formula (9)}$$

Accordingly, difference Δhw between the maximum value and the minimum value of the fluctuation of slit gap h can be expressed by Formula (10).

$$\Delta h\leqq h\times(\Delta hw_{max}/hw)/3 \quad \text{Formula (10)}$$

When hd represents the post-drying coating thickness and Δhw represent permissible maximum value $\Delta hw_{max}$ of the difference between the maximum value and the minimum value of the fluctuation of the post-drying lateral coating thickness, then the pre-drying coating thickness distribution is maintained. Therefore, $\Delta hw_{max}$ can be expressed by Formula (11).

$$\Delta hw_{max}/hw=\Delta hw_{max}/hd \quad \text{Formula (11)}$$

Accordingly, Formula (12) can be obtained by substituting Formula (11) for Formula (10).

$$\Delta h\leqq h\times(\Delta hd_{max}/hd)/3 \quad \text{Formula (12)}$$

The inventors conducted the experiment on the basis of the formula (12), and confirmed the effect of the present invention.

Namely, in order to obtain excellent post-drying coating thickness distribution, as shown in Formula (12), difference Δh between the maximum value and the minimum value of the fluctuation of the slit gap is to be set in accordance with the magnitude of permissible maximum value $\Delta hd_{max}$ of difference Δhw between the maximum value and the minimum value of the fluctuation of lateral post-drying coating thickness. It is not preferable that Δh exceeds $h\times(\Delta hd_{max}/hd)/3$, because difference Δhd between the maximum value and the minimum value of the fluctuation of lateral coating width exceeds permissible maximum value $\Delta hd_{max}$ and desired products cannot thereby be obtained.

When coating is carried out employing the single layer extrusion coater shown in FIG. 3, effects of the shape of the pocket section on the stability of coating thickness will now be described.

Pressure loss ΔPp (in Pa) of the pocket section is expressed by Formula (13) based on the Hagen Poisellue Law in regard to flow in a tube.

$$\Delta Pp(\text{in } Pa)=32\times\mu\times v\times X/(2+R)^2 \quad \text{Formula (13)}$$

wherein v represents the lateral coating flow rate (in mm/s) in the pocket. Said lateral coating flow rate v (in mm/s) in the pocket can be expressed by Formula (14).

$$v=(\text{flow rate in the pocket})/(\text{cross-sectional area of the pocket})=(\text{coating liquid amount}=\text{coating liquid supply amount})/(\text{cross-sectional area of the pocket})=hw\times u\times X/\pi\times R^2 \quad \text{Formula (14)}$$

Accordingly, Formula (15) is obtained by substituting Formula (14) for Formula (13).

$$\Delta Pp(\text{in } Pa)=8\times\mu\times hw\times u\times X^2/(\pi\times R^4) \quad \text{Formula (15)}$$

The inventors of the present invention conducted investigations to optimize pocket pressure loss ΔPs (in Pa) in order to improve lateral coating thickness distribution. As a result, it was discovered that the ratio of ΔPp (in Pa) to the aforesaid slit pressure loss ΔPs (in Pa) was critical and satisfying the relationship expressed by Formula (16) was essential.

$$\Delta Pp/\Delta Ps<4\times(\Delta hw/hw)=4\times(\Delta hd/hd) \quad \text{Formula (16)}$$

Namely, in order to improve said lateral coating thickness distribution, the pressure loss ratio (ΔPp/ΔPs) of the pocket to the slit is to be proportional to the ratio of difference Δhd between the maximum value and the minimum value of the fluctuation of the post-drying coating thickness to average thickness hd, namely the post-drying coating layer thickness distribution, and its coefficient is to be 4.

Accordingly, when it is desired to improve the layer thickness distribution by a factor of ½, it is found that said pressure loss ratio is also to be ½. In order to accomplish that, slit pressure loss ΔPs may be doubled or pocket pressure loss may be reduced by half. Further, when it is desired that said layer thickness distribution is to be within 0.03 or 3 percent, the pressure loss ratio ΔPp/ΔPs of the pocket to the slit may be set at 0.12, that is four times said value, namely, pocket pressure loss ΔPp may be set at less than or equal to approximately 0.12 time.

By substituting Formula (16), as obtained above, and Formula (15) for Formula (1) and rearranging the results, Formula (17) is obtained.

$$(X^2/R^4)/(Ls/h^3)<18\times\Delta hd/hd) \quad \text{Formula (17)}$$

Namely, Formula (16) is replaced with a ratio of $(X^2/R^4)$, which is a component due to the resistance in the pocket section to ($Ls/h^3$) which in turn is a component due to the resistance of the slit. When the cross-sectional shape of the pocket is circular, equivalent radius R (in mm) may be its radius. When said shape is not circular, equivalent radius R can be obtained employing Formula (18).

$$R = \tfrac{1}{2} \times (\text{cross-sectional area of the pocket})/(\text{peripheral length of the pocket cross-section}) \quad \text{Formula (18)}$$

When coating is carried out employing the single layer extrusion coater shown in FIG. 2, the relationship between the distortion magnitude of the slit due to slit pressure loss ΔPs and the coating stability will now be described. The inventors of the present invention conducted investigations on degradation causes in layer thickness distribution. As a result, it was discovered that force due to slit pressure loss ΔPs was almost perpendicularly applied to the interior wall surface as well as the slit constituting surface, and due to that, slit gap h was increased and distorted due to the distortion of the bar which was constituted in the direction which enforced widening of the slit, whereby the resulting layer thickness distribution was degraded.

Further, the inventors of the present invention conducted investigations to discover means to maintain said layer thickness distribution in the permissible range. Subsequently, it was discovered that the permissible range of said distortion magnitude, namely the relationship between the variation amount $\Delta h_{out}$ of the slit outlet gap and the slit gap is required to be such that the relationship expressed by Formula (19) is satisfied.

$$\Delta h_{out} \leqq 9\Delta h \quad \text{Formula (19)}$$

Namely, it is necessary that slit outlet gap variation amount $\Delta h_{out}$ is adjusted to be approximately 9 times the difference Δh between the maximum value and the minimum value of the variation of slit gap h.

As a result of considering the method to estimate the dispersion amount in the slit outlet gap $\Delta h_{out}$ from the slit pressure loss ΔPs (in Pa), the inventor found that it is possible to estimate by the following way.

Nearly uniform pressure, which is the same as slit pressure loss ΔPs, is to be applied to the interior wall surface of the pocket section as well as the slit-constituting surface. On the other hand, in a slit section having a slit length Ls, pressure uniformly decreases toward the slit outlet from the pocket side. As a result, at the slit outlet, pressure becomes almost the same as atmospheric pressure, namely slit pressure loss ΔPs becomes zero, resulting in a primary distribution load. As a result, average slit pressure loss ΔPs becomes ΔPs/2. Accordingly, average pressure P, which is applied to the interior wall surface of the pocket section as well as the slit-constituting surface is expressed by Formula (20).

Formula (20)

$$P = (Ls(\Delta Ps/2) + Lp\Delta Ps)/(Ls + Lp)$$
$$= \Delta Ps(Ls/2 + Lp)/L$$

wherein L represents the sum of Ls and Lp.

Further, slit outlet gap variation amount $\Delta h_{out}$ can be expressed by Formula (21).

Formula (21)

$$\Delta h_{out} = 3PL^4/(2Et_1^3) + 3PL^4/(2Et_2^3)$$
$$= 3(t_1^{-3} + t_2^{-3})PL^4/2E$$

wherein E represents Young's modulus of the bar forming the slit.

Herein, the first term to the right of Formula (21) represents the transformation magnitude of the bar on the upstream side, while the s term represents deformation magnitude of the bar on the downstream side. Namely, since the transformation magnitude of the bar on the upstream side and the transformation magnitude of the bar on the downstream side are subjected to transformation in the opposite directions, resulting slit outlet gap variation amount $\Delta h_{out}$ increases.

According to the present invention, as described above, when $\Delta h_{out}$ satisfies Formula (19) $\Delta h_{out} \leqq 9\Delta h$, it is possible to minimize the degradation of the layer thickness distribution. Accordingly, when Formula (12) is substituted for Formula (19), Formula (22) is obtained.

$$\Delta h_{out} \leqq 9\Delta h \leqq 9h(\Delta hd/hd)/3 = 3h(\Delta hd/hd) \quad \text{Formula (22)}$$

By substituting Formula (21) for Formula (22) and rearranging the results, Formula (23) is obtained.

$$3(t_1^{-3} + t_2^{-3})PL^4/2E \leqq 3h(\Delta hd/hd) \quad \text{Formula (23)}$$

By substituting Formulas (1) and (20) for formula (23) and rearranging the results, Formula (24) is obtained.

$$6(t_1^{-3} + t_2^{-3})\mu \times hw \times u \times Ls(Ls/2 + Lp)L^3/(h^4E) \leqq \Delta hd/hd \quad \text{Formula (24)}$$

As a result that the inventor conducted the confirmation experiment, the inventor confirmed that a coater, which satisfies the relationship expressed by Formula (24), is one which results in excellent stability of coating thickness distribution. The inventor further found that the coating layer thickness distribution can be made preferably by producing the coater which satisfies the above formula.

Figure 4:
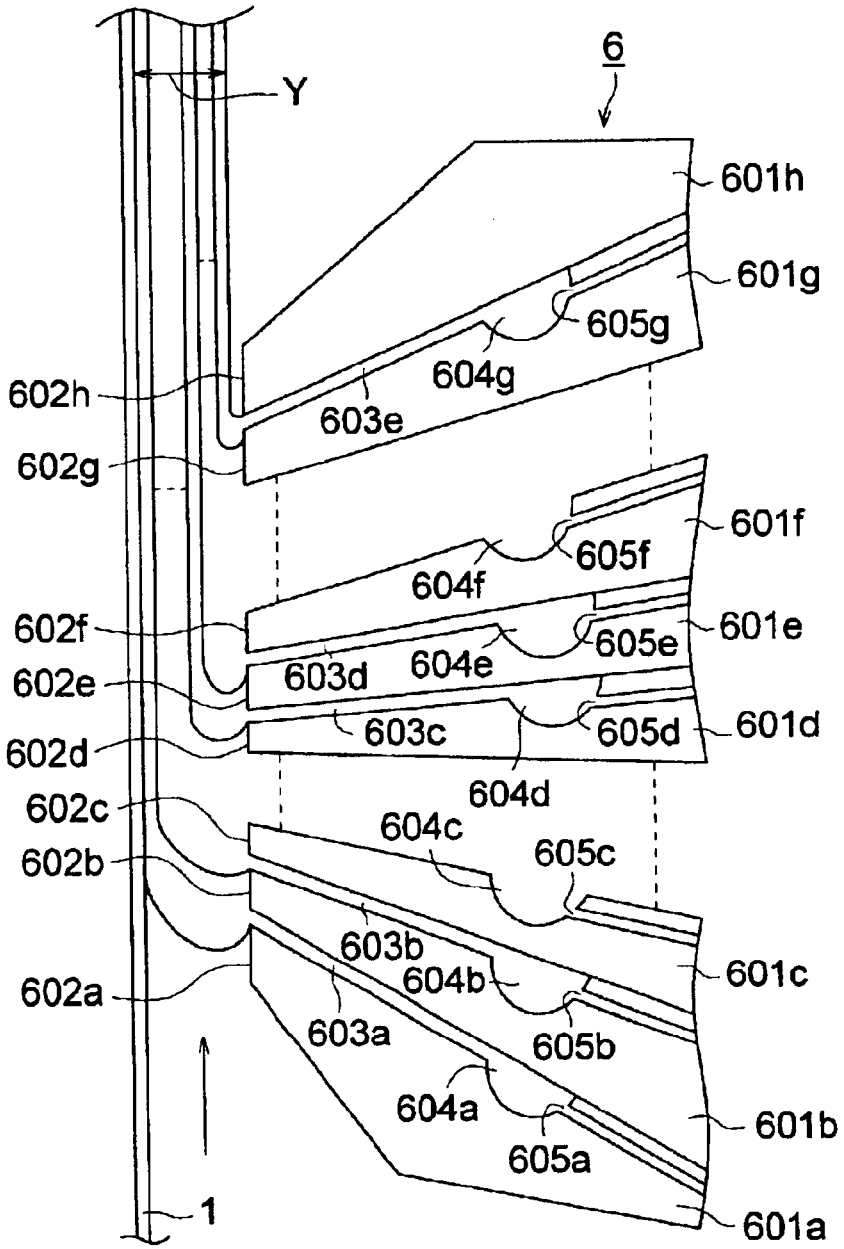
FIG. 4 is a partially enlarged schematic cross-sectional view showing the state in which coating is carried out employing an extrusion coater for simultaneously coating n layers provided with at least two sets each of which consisting of a slit and a pocket instead of extrusion coater 3 shown in FIG. 2.

Instead of extrusion coater 3 shown in FIG. 2, FIG. 4 is a partially enlarged schematic cross-sectional view of the state in which coating is carried out employing a simultaneous n-layer extrusion coater provided with at least two sets consisting of a slit and a pocket. It is possible to constitute said simultaneous n-layer extrusion coater shown in FIG. 4, while increasing the number of sets of bars comprised of the pocket section and the slit of the single layer extrusion coater shown in FIG. 2 while matching the number of required coatings. In the present invention, n is from 2 to 30.

In FIG. 4, numeral 6 shows a simultaneous n-layer extrusion coater. Numerals 601*a* through 601*h* each represents a bar constituting extrusion coater 6 and is fixed employing bolts (not shown). Numerals 602*a* through 602*h* each represents the lip at the tip of each bar.

Numerals 603*a* through 603*e* each shows a slit which is formed between bars. Numerals 604*a* through 604*g* each shows an extendable pocket section is provided laterally with respect to coater 3. Numerals 605*a* through 605*g* each shows a coating liquid supply port installed in each pocket section of numerals 604*a* through 604*g*.

All functions of the bar, slit, pocket and lip shown in FIG. 4 are the same as those of the single layer extrusion coater shown in FIG. 2.

Symbol Y shows a coating layer which is prepared in such a manner that coating liquid, which is supplied to the center of each pocket in the lateral direction or an optional position from the coating liquid supply port provided in each pocket, is spread in the lateral direction of coating, and subsequently, the resultant coating liquid is extruded from each slit through each lip and applied onto belt-shaped support 1.

Both coating width edges of said extrusion coater are sealed so as to obtain the desired coating width, employing various width regulating means as well as limiting side plates.

In FIG. 4, the upstream side, as described herein, refers to the arrowed direction (in FIG. 4, from the lower level to the upper level) and the side on which belt-shaped support 1 is fed. Namely, the bar on the uppermost stream side refers to bar 601*a*.

In the extrusion coater for simultaneously coating n layers shown in FIG. 4, for example, the bar in the order of i may refer to 601*e*; the bar in the order of i+1 may refer to 601*f*; and the bar in the order of i−1 may refer to 601*d*.

Figure 5:
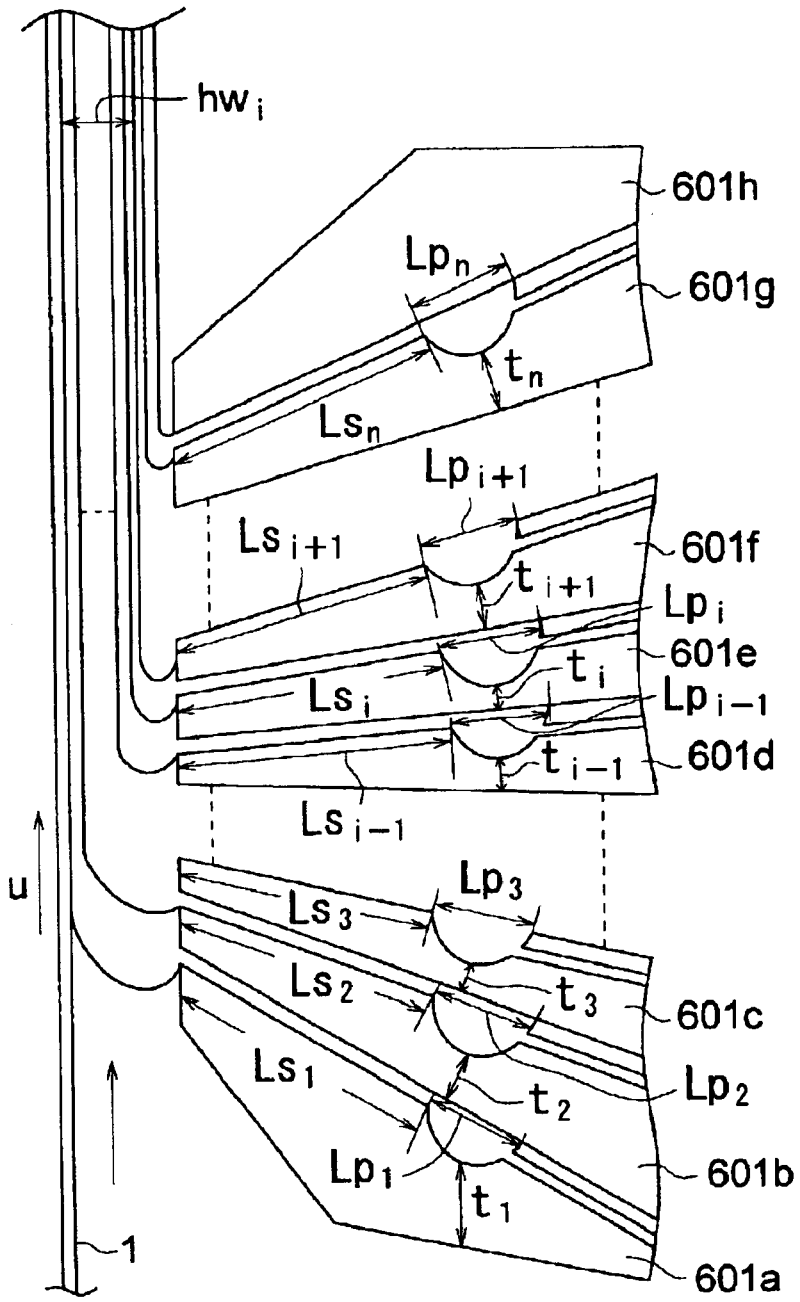
FIG. 5 is a view for explaining each formula in regard to the coating thickness stability with each slit resistance, each slit gap, the viscosity of each coating liquid of the extrusion coater for simultaneously coating n layers when coating is carried out employing said extrusion coater for simultaneously coating n layers shown in FIG. 4.

FIG. 5 is a view explaining each formula in regard to the coating thickness stability with each slit resistance, each slit gap, the viscosity of each coating liquid of the extrusion coater for simultaneously coating n layers when coating is carried out employing said extrusion coater for simultaneously coating n layers shown in FIG. 4.

In FIG. 5, $hw_i$ shows pre-drying coating thickness (in mm) in the order from the lowest layer to i layer which is prepared in such a manner that coating liquid, which is supplied to the center of each pocket in the lateral direction or an optional position from the coating liquid supply port provided in each pocket, is spread in the lateral direction of coating, and subsequently, the resultant coating liquid is extruded from each slit through each lip and applied onto belt-shaped support 1.

$Ls_1$, $Ls_2$, and $Ls_3$ each shows the length (in mm) of the uppermost stream slit to the third slit, while $Ls_{i-1}$, $Ls_i$, $Ls_{i+1}$ each shows the length (in mm) of the uppermost stream slit to the length of the slit in the order of n.

$Lp_1$, $Lp_2$, and $Lp_3$ each shows the length (in mm) of the cross-section of each pocket in the slit length direction from the uppermost stream side to the third, while $Lp_{i-1}$, $Lp_i$, and $Lp_{i+1}$, each shows the length (in mm) of the cross-section of each pocket section in the slit length direction from the uppermost stream to the order of i. $Lp_n$ shows the length (in mm) of the cross-section of the pocket in the order of n.

$t_1$, $t_2$, and $t_3$ each shows the thickness of the thinnest portion of the pocket section from the uppermost side to the third, while $t_{i-1}$, $t_i$, and $t_{i+1}$ each shows the thickness of the thinnest portion of the pocket section of each bar from the uppermost stream side to the third. Further, $t_n$ shows the thickness of the thinnest portion of the pocket section of each bar in the order of n.

Other numerals as well as symbols are the same as defined in FIGS. 2 and 4.

The inventors of the present invention conducted diligent investigations to overcome problems with the extrusion coater for simultaneous coating n layers shown in FIG. 4. As a result, it was discovered that degradation causes of the layer thickness distribution were the same as the single layer extrusion coater. Further it was also discovered that since force due to the aforesaid slit pressure loss ΔPs is almost perpendicularly applied to the interior wall surface of the pocket as well as the slit constituting surface, the aforesaid block is distorted in the direction so as to enforcedly increase slit gap h, whereby the layer distribution is degraded.

Further, the layer distribution may be maintained within the permissible range as follows. The permissible range of said deformation magnitude, namely slit outlet gap variation amount $\Delta h_{out}$ may be increased approximately to 9 times or less the difference Δh between the maximum value and the minimum value of the slit gap. This is the same as for the single layer coating extrusion coater.

In an extrusion coater which is capable of simultaneously coating at least two layers, however, said distortion magnitude in the intermediate block, arranged between slits, becomes less than the aforesaid amount due to the formation of pushing-back due to the slit pressure of adjacent layers.

Accordingly, slit outlet gap deformation magnitude $\Delta h_{outi}$ is expressed by Formula (25) while subtracting the push-back difference due to the slit pressure of the adjacent layer.

$$\Delta h_{outi}=\{(3\times P_i\times L_i^4-3\times P_{i-1}\times L_{i-1}^4)(2\times E\times t_i^3)\}+\{(3\times P_i\times L_i^4-3\times P_{i+1}\times L_{i+1}^4)/(2\times E\times t_{i+1}^3)\} \quad \text{Formula (25)}$$

wherein P represents the average pressure applied to the interior wall surface of the pocket for each layer and the slit constituting surface; $P_1$, $P_2$, . . . $P_{i-1}$, $P_i$, $P_{i+1}$, . . . $P_n$ each represents said pressure in the order from the layer on the upstream side; E represents Young's modulus of the coater member; $L_i$ represents the sum of slit length $Ls_i$ of order i from the uppermost stream side and the length of the cross-section of the pocket section in the slit length direction; $L_{i-1}$ represents the sum of slit length $Ls_{i-1}$ in the order i−1 from the uppermost stream side and length $Lp_{i-1}$ of the cross-section of the pocket in the slit direction; and $L_{i+1}$ represents the sum of slit length $Ls_{i+1}$ in order i+1 from the uppermost stream side and $Lp_{i+1}$ of the length of cross-section of the pocket in the slit direction.

In multilayer coating employing at least two layers, it is desirous that each slit outlet gap deformation magnitude $\Delta h_{outi}$ is represented by Formula (26):

$$\Delta h_{outi}\leqq 3\times h_i\times(\Delta hd_i/hd_i) \quad \text{Formula (26)}$$

wherein $\Delta hd_i$ represents the difference between the maximum value and the minimum value of fluctuation of the post-drying coating thickness in the order i from the upstream side, and $hd_i$ represents the post-drying coating thickness in the order i from the upstream side.

Accordingly, Formula (27) is derived from Formulas (25) and (26).

$$\{(P_i\times L_i^4-P_{i-1}\times L_{i-1}^4)/(E\times t_i^3)\}+\{P_i\times Li^4-P_{i+1}\times L_{i+1}^4\}/(E\times t_{i+1}^3)\}\leqq 2h_i(\Delta hd_i/hd_i) \quad \text{Formula (27)}$$

Formula (28) is obtained by rearranging Formula (27) $P_i\times L_i^4\times t_i^{-3}-P_{i-1}\times L_{i-1}^4\times t_i^{-3}+P_i\times L_i^4\times t_{i+1}^{-3}-P_{i+1}\times L_{i+1}^4\times t_{i+1}^{-3}\leqq 2h_i(\Delta hd_i/hd_i)E$ $$P_i\times L_i^4\times(t_i^{-3}+t_{i+1}^{-3})-P_{i-1}\times L_{i-1}^4\times t_i^{-3}-P_{i+1}\times L_{i+1}^4\times t_{i+1}^{-3}\leqq 2h_i(\Delta hd_i/hd_i)E \quad \text{Formula (28)}$$

Further, $Pi=\Delta Ps_i(Ls_i/2+Lp_i)/L_i$ is derived from Formula (20) and $\Delta Ps_i=12\times\mu_i\times Ls_i\times hw_i\times u/h_i^3$ is derived from Formula (1). Accordingly, $P_{i-1}$, $P_i$, and $P_{i+1}$, average pressure applied to the interior wall surface of the pocket in the order i−1, i, and i+1, and the slit constituting surface is expressed by Formulas (29), (30), and (31), respectively.

$$P_{i-1}=12\times\mu_{i-1}\times Ls_{i-1}\times hw_{i-1}\times u(Ls_{i-1}/2+Lp_{i-1})/(L_{i-1}\times h_{i-1}^3) \quad \text{Formula (29)}$$

$$P_i=12\times\mu_i\times Ls_i\times hw_i\times u(Ls_i/2+Lp_i)/(L_i\times h_i^3) \quad \text{Formula (30)}$$

$$P_{i+1}=12\times\mu_{i+1}\times Ls_{i+1}\times hw_{i+1}\times u(Ls_{i+1}/2+Lp_{i+1})/(L_{i+1}\times h_{i+1}^3) \quad \text{Formula (31)}$$

When above formulas are substituted for Formula (28) and the resultant formula is rearranged, Formula (32) is obtained.

$$6\times(t_i^{-3}+t_{i+1}^{-3})\times\mu_i\times hw_i\times u\times Ls_i$$
$$\times(Ls_i/2+Lp_i)\times$$
$$L_i^3/h_i^3-6(t_i^{-3}\times\mu_{i-1}\times hw_{i-1}$$
$$\times u\times Ls_{i-1})\times$$
$$(Ls_{i-1}/2+Lp_{i-1})\times$$
$$L_{i-1}^3/h_{i-1}^3-6\times(t_{i+1}^{-3}\times\mu_{i+1}$$
$$\times hw_{i+1}\times u\times$$
$$Ls_{i+1})\times(Ls_{i+1}/2+$$
$$Lp_{i+1})\times L_{i+1}^3/h_{i+1}^3\leq h_i$$
$$(\Delta hd_i/hd_i)E \qquad \text{Formula (32)}$$

wherein $Ps_i$ represents Ps of the slit in the order i from the upstream side; $\mu_i$ represents the viscosity of the coating liquid in the order i from the upstream side; $hw_i$ represents the pre-drying coating thickness in the order i from the upstream side; and $h_i$ represents the slit gap in the order i from the upstream side.

Formulas (1) through (32) of the present invention are formulated based on extrusion coaters as a representative coater having a slit as well as a pocket. However, it is possible to apply those formulas to coaters having the slit as well the pocket such as slide coaters, curtain coaters, and the like.

Belt-shaped supports employed in the present invention include paper, plastic film, resin coated paper, and synthetic paper. Employed as materials of plastic film are, for example, polyolefins such as polyethylene and polypropylene; vinyl polymers such as polyvinyl acetate and polyvinyl chloride; polyamides such as 6,6-nylon and 6-nylon; polyesters such as polyethylene terephthalate (hereinafter referred to as "PET"), polyethylene-2,6-naphthalene dicarboxylate (hereinafter referred to as "PEN"); polycarbonate; and polyesters such as cellulose triacetate and cellulose diacetate. Representative resins, which are employed for said resin coated paper, include polyolefins such as polyethylene and the like, but are not limited to these. Further, it is possible to employ those which have been subjected to treatments such as surface treatment and subbing. In addition, it is possible to apply coating liquid onto belt-shaped supports onto which other liquid have been applied. Further, the thickness of belt-shaped supports employed is not particularly limited.

Coating liquids employed in the present invention are not particularly limited. Listed as coating liquids are, for example, those of light-sensitive photographic materials, heat developable recording materials, ablation recording materials, magnetic recording media, and steel plate surface processing. Further, said coating liquids, when applied, may be applied to other coating liquids such as subbing liquid, overcoating liquid, and backing layer liquid.

EXAMPLES

Example 1

An organic silver containing photosensitive layer coating liquid was prepared employing the method described below.

<Photosensitive Layer Coating Liquid>

<<Preparation of Silver Halide Emulsion A>>

In 900 ml of water were dissolved 7.5 g of inert gelatin and 10 mg of potassium bromide. The temperature and pH of the resultant mixture were adjusted to 35° C. and 3.0, respectively. Subsequently, 370 ml of an aqueous solution, containing 74 g of silver nitrate and 370 ml of an aqueous solution containing potassium bromide and potassium iodide at a mole ratio of 98/2 in an equimolar amount with respect to silver nitrate, $Ir(NO)Cl_5$ in an amount of $1\times10^{-6}$ mole per mole of silver, and rhodium chloride in an amount of $1\times10^{-6}$ mole per mole of silver, were added employing a control double jet method while maintaining the pAg at 7.7. Thereafter, 4-hydroxy-6-methyl-1,3,3a,7-tetraazaindene was added, and subsequently, the pH was adjusted to 5 by adding NaOH, whereby cubic silver iodide grains were prepared which had an average grain size of 0.06 μm, a monodispersibility of 10 percent, a projection diameter area variation coefficient of 8 percent, and a [100] plane ratio of 87 percent. The resultant emulsion was coagulated employing coagulators and desalted. Thereafter, after adding 0.1 g of phenoxyethanol, the pH and pAg were adjusted to 5.9 and 7.5, respectively, whereby a silver halide emulsion was prepared. Subsequently, the resultant emulsion underwent chemical sensitization employing chloroauric acid as well as inorganic sulfur, whereby Silver Halide Emulsion A was prepared.

The monodispersibility and the projection diameter area variation coefficient were determined employing the formulas described below.

Monodispersibility=(standard deviation of the grain diameter)/(average of the grain diameter)×100

Projection diameter area variation coefficient=(standard deviation of the projection diameter area)/(average of the projection diameter area)×100

<<Preparation of Sodium Behenate Solution>>

At 90° C., 32.4 g of behenic acid, 9.9 g of arachidic acid, and 5.6 g of stearic acid were dissolved in 945 ml of pure water. Subsequently, while stirring at a high speed, 98 ml of 1.5 mole/L aqueous sodium hydroxide solution was added. After adding 0.93 ml of concentrated nitric acid, the resulting mixture was cooled to 55° C. and stirred for 30 minutes, whereby a sodium behenate solution was prepared.

(Preparation of Pre-Form Emulsion)

After adding said sodium behenate solution to 15.1 g of said Silver Halide Emulsion A, the pH was adjusted to 8.1 by adding sodium hydroxide. Subsequently, 147 ml of 1 mole/L silver nitrate solution was added over 7 minutes and stirred for an additional 20 minutes. Thereafter, water-soluble salts were removed employing ultrafiltration. The resultant sodium behenate was comprised of grains having an average grain diameter of 0.8 μm and a monodispersibility of 8 percent. After forming a flock of the resultant dispersion, water was removed, and water washing and water removal were carried out 6 times. Subsequently, 544 g of a methyl ethyl ketone solution of polyvinyl butyral (having an average molecular weight of 3,000, 17 percent by weight) and 107 g of toluene were gradually added and stirred. Thereafter, the resulting mixture was dispersed employing a media homogenizer, whereby a pre-form emulsion was prepared.

<Preparation of Photosensitive Layer Coating Liquid>

| | |
|---|---|
| Pre-form Emulsion | 240 g |
| Sensitizing Dye 1 (0.1 percent methanol solution) | 1.7 ml |
| Pyridiniumpromidoperpromide (6 percent methanol solution) | 3 ml |
| Calcium bromide (0.1 percent methanol solution) | 1.7 ml |
| Antifoggant 1 (10 percent methanol solution) | 1.2 ml |
| 2-(4-Chlorobenzoylbenzoic acid) (12 percent methanol solution) | 9.2 ml |
| 2-Mercaptobenzimidazole (1 percent methanol solution) | 11 ml |
| Tribromomethylsulfoquinoline (5 percent methanol solution) | 17 ml |
| Developing Agent 1 (20 percent methanol solution) | 29.5 ml |

Sensitizing Dye 1

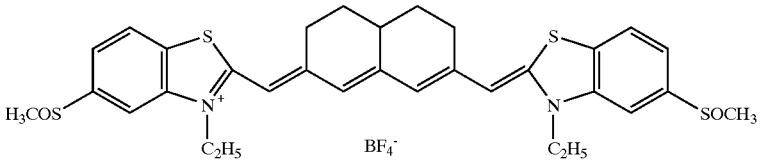

Antifoggant 1

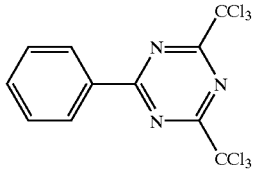

Developing Agent 1

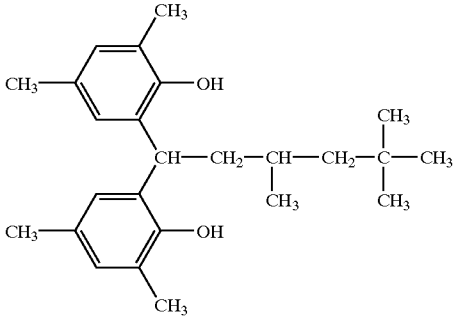

Viscosity $\mu$ (in Pa·s) of the photosensitive layer coating liquid, prepared as above, was adjusted to 0.5 Pa·s. The resultant coating liquid was applied onto a 175 $\mu$m thick PET base, belt-shaped support, with a length of 10,000 m at a coating rate of 1,000 mm/s so as to obtain a pre-drying coating thickness hw (in mm) of 0.05 mm, employing the single layer extrusion coater, utilizing a coating system in which a back roller was employed as shown in FIG. 1(*a*).

Coating was carried out varying slit pressure loss ΔPs (in Pa) by altering slit length Ls (in mm) as well as slit gap h (in mm) of the single layer extrusion coater employed, and subsequently, the resultant coating was dried, whereby Samples 101 through 125 shown in Table 1 were prepared. Incidentally, the coating length of each sample was 1,000 m. The lateral coating thickness fluctuation (in percent) of each of Samples 101 through 125 was determined. Table 1 summarizes the results. Incidentally, slit pressure loss ΔPs (in Pa) was obtained through computation, employing Formula (1).

The lateral coating thickness fluctuation (in percept) of each-sample was determined as described below. The lateral coating thickness including the support was measured at 18 positions at an interval of 50 mm of the full coating width located 10 m from the end of the coating. Thereafter, the coating at each measured position was peeled off employing nonwoven fabric damped with methyl ethyl ketone, and the thickness of the belt-shaped support was determined. The difference between the measured values was designated as thickness of the coating. Based on the obtained results, the ratio of the difference between the maximum value and the minimum value to the average was computed in percent. The coating thickness was determined employing a contact type layer thickness meter (Denki Micrometer Minicom M, manufactured by Tokyo Seimitsu Co.). Viscosity was determined employing a Rotobisco RV-12 of Haake Co., whereby each viscosity at shearing was measured.

TABLE 1

| Sample No. | Slit Length Ls (in mm) | Slit Gap h (in mm) | Slit Pressure Loss ΔPs (in Pa) | Lateral Coating Thickness Fluctuation (in %) | Remarks |
|---|---|---|---|---|---|
| 101 | 50 | 0.25 | $9.6 \times 10^5$ | 7.9 | Comparative |
| 102 | 50 | 0.3 | $5.6 \times 10^5$ | 6.8 | Comparative |
| 103 | 50 | 0.35 | $3.5 \times 10^5$ | 3.1 | Present Invention |
| 104 | 50 | 0.4 | $2.3 \times 10^5$ | 2.1 | Present Invention |
| 105 | 50 | 0.5 | $1.2 \times 10^5$ | 1.4 | Present Invention |
| 106 | 60 | 0.3 | $6.7 \times 10^5$ | 7.6 | Comparative |
| 107 | 60 | 0.35 | $4.2 \times 10^5$ | 4.8 | Comparative |
| 108 | 60 | 0.4 | $2.8 \times 10^5$ | 2.5 | Present Invention |
| 109 | 60 | 0.5 | $1.4 \times 10^5$ | 1.5 | Present Invention |
| 110 | 60 | 0.75 | $4.3 \times 10^4$ | 0.8 | Present Invention |
| 111 | 75 | 0.3 | $8.3 \times 10^5$ | 7.8 | Comparative |
| 112 | 75 | 0.35 | $5.2 \times 10^5$ | 5.5 | Comparative |
| 113 | 75 | 0.4 | $3.5 \times 10^5$ | 2.9 | Present Invention |
| 114 | 75 | 0.5 | $1.8 \times 10^5$ | 1.1 | Present Invention |
| 115 | 75 | 0.75 | $5.3 \times 10^4$ | 0.9 | Present Invention |
| 116 | 100 | 0.3 | $1.1 \times 10^6$ | 7.7 | Comparative |
| 117 | 100 | 0.4 | $4.7 \times 10^5$ | 5.0 | Comparative |
| 118 | 100 | 0.45 | $3.3 \times 10^5$ | 2.5 | Present Invention |
| 119 | 100 | 0.5 | $2.4 \times 10^5$ | 1.5 | Present Invention |
| 120 | 100 | 0.75 | $7.1 \times 10^4$ | 1.0 | Present Invention |
| 121 | 75 | 1.0 | $2.3 \times 10^4$ | 1.1 | Present Invention |
| 122 | 50 | 1.0 | $1.5 \times 10^4$ | 2.3 | Present Invention |
| 123 | 35 | 1.0 | $1.1 \times 10^4$ | 3.0 | Present Invention |
| 124 | 30 | 1.0 | $9.0 \times 10^3$ | 7.9 | Comparative |
| 125 | 20 | 1.0 | $6.0 \times 10^3$ | 11.5 | Comparative |

When $1\times10^4$ $\Delta Ps \leqq 4\times10^5$, fluctuation (in percent) in the lateral coating thickness was less than or equal to approximately 3 percent. Accordingly, it was possible to obtain excellent thickness distribution compared to the case of $\Delta Ps > 4\times10^5$, whereby the effects of the present invention were confirmed.

Example 2

The photosensitive layer coating liquid, employed in Example 1, was applied onto the same belt-shaped support as in Example 1 at a coating rate of 1,000 mm/s employing a single layer extrusion coater having a silt length Ls (in mm) of 75 mm and a slit gap h (in mm) of 0.3 mm, while employing the same coating system as Example 1.

Coating was carried out varying slit pressure loss ΔPs (in Pa) by altering coating liquid viscosity $\mu$ (in Pa·s) as well as pre-drying coating thickness hw (in mm) upon adjusting the amount of methyl ethyl ketone, and subsequently, the resultant coating was dried, whereby Samples 201 through 209 shown in Table 2 were prepared. Incidentally, the coating length of each sample was 1,000 m. The lateral coating thickness fluctuation (in percent) of each of Samples 201 through 205 was determined. Table 2 shows the results.

Incidentally, slit pressure loss ΔPs (in Pa) was determined in the same manner as in Example 1. Lateral coating thickness fluctuation (in percent) was determined employing the same method as in Example 1.

TABLE 2

| Sample No. | Coating Liquid Viscosity $\mu$ (in Pa • s) | Pre-Drying Coating Thickness hw (in mm) | Slit Pressure Loss ΔPs (in Pa) | Lateral Coating Thickness Fluctuation (in %) | Remarks |
|---|---|---|---|---|---|
| 201 | 2.0 | 0.01 | $6.7 \times 10^5$ | 8.2 | Comparative |
| 202 | 0.8 | 0.02 | $5.3 \times 10^5$ | 7.9 | Comparative |
| 203 | 0.4 | 0.03 | $4.0 \times 10^5$ | 1.5 | Present Invention |
| 204 | 0.2 | 0.05 | $3.3 \times 10^5$ | 1.0 | Present Invention |
| 205 | 0.05 | 0.1 | $1.7 \times 10^5$ | 0.7 | Present Invention |
| 206 | 0.01 | 0.2 | $6.7 \times 10^4$ | 0.9 | Present Invention |
| 207 | 0.001 | 0.4 | $1.3 \times 10^4$ | 1.2 | Present Invention |
| 208 | 0.0003 | 0.8 | $8.0 \times 10^3$ | 5.5 | Comparative |
| 209 | 0.0001 | 1.0 | $3.3 \times 10^3$ | 15.0 | Comparative |

When $\Delta Ps \leqq 4\times10^5$, the resultant lateral coating thickness fluctuation (in percent) became less than or equal to approximately 3 percent. Accordingly, it was possible to obtain excellent thickness distribution compared to the case of $\Delta Ps > 4\times10^5$, whereby the effects of the present invention were confirmed.

Example 3

The photosensitive layer coating liquid, employed in Example 1, was applied onto the same belt-shaped support employed in Example 1 so as to obtain pre-drying coating thickness hw (in mm) of 0.1 mm, employing a single layer extrusion coater having slit length Ls (in mm) of 75 mm and slit gap h (in mm) of 0.5 mm, while employing the same coating system as Example 1.

Coating was carried out varying slit pressure loss ΔPs (in Pa) by altering coating rate u (in mm/s), and subsequently, the resultant coating was dried, whereby Samples 301 through 310, shown in Table 3, were prepared. Incidentally, the coating length of each sample was 1,000 m. The lateral coating thickness fluctuation (in percent) of each of obtained Samples 301 through 310 was determined. Table 3 shows the results.

Incidentally, slit pressure loss ΔPs (in Pa) was determined in the same manner as in Example 1. Lateral coating thickness fluctuation (in percent) was determined employing the same method as in Example 1.

TABLE 3

| Sample No. | Coating Rate u (in mm/s) | Slit Pressure Loss ΔPs (in Pa) | Lateral Coating Thickness Fluctuation (in %) | Remarks |
|---|---|---|---|---|
| 301 | 15 | $5.4 \times 10^3$ | 13.5 | Comparative |
| 302 | 25 | $9.0 \times 10^3$ | 8.5 | Comparative |
| 303 | 50 | $1.8 \times 10^4$ | 2.5 | Present Invention |
| 304 | 300 | $1.1 \times 10^5$ | 0.7 | Present Invention |
| 305 | 500 | $1.8 \times 10^5$ | 1.3 | Present Invention |
| 306 | 750 | $2.7 \times 10^5$ | 1.8 | Present Invention |
| 307 | 1000 | $3.6 \times 10^5$ | 2.1 | Present Invention |
| 308 | 1500 | $5.4 \times 10^5$ | 6.3 | Comparative |

TABLE 3-continued

| Sample No. | Coating Rate u (in mm/s) | Slit Pressure Loss ΔPs (in Pa) | Lateral Coating Thickness Fluctuation (in %) | Remarks |
|---|---|---|---|---|
| 309 | 2000 | $7.2 \times 10^5$ | 7.3 | Comparative |
| 310 | 3000 | $1.1 \times 10^6$ | 8.8 | Comparative |

When $\Delta Ps \leqq 4\times10^5$, the resultant lateral coating thickness fluctuation (in percent) became less than or equal to approximately 3 percent. Accordingly, it was possible to obtain excellent thickness distribution compared to the case of $\Delta Ps > 4\times10^5$, whereby the effects of the present invention were confirmed.

Example 4

The photosensitive layer coating liquid, employed in Example 1, was applied onto the same belt-shaped support employed in Example 1 at coating rate u (in mm/s) of 1,000 mm/s so as to obtain pre-drying coating thickness hw (in mm) of 0.05 mm, employing a single layer extrusion, while employing a coating system which did not use the back roller shown in FIG. 1(*b*).

Coating was carried out varying slit pressure loss ΔPs (in Pa) by altering slit length Ls (in mm) and slit gap h (in mm), and subsequently, the resultant coating was dried, whereby Samples 401 through 436, shown in Tables 4 and 5, were prepared. Incidentally, the coating length of each sample was 1,000 m. The lateral coating thickness fluctuation (in percent) of each of obtained Samples 401 through 436 was determined. Tables 4 and 5 show the results. Incidentally, slit pressure loss ΔPs (in Pa) was determined employing the same method as in Example 1.

Lateral coating thickness fluctuation (in percent) was determined employing the same method as in Example 1.

TABLE 4

| Sample No. | Slit Length Ls (in mm) | Slit Gap h (in mm) | Slit Pressure Loss ΔPs (in Pa) | Lateral Coating Thickness Fluctuation (in %) | Remarks |
|---|---|---|---|---|---|
| 401 | 50 | 0.25 | $9.6 \times 10^5$ | 12.0 | Comparative |
| 402 | 50 | 0.3 | $5.6 \times 10^5$ | 8.5 | Comparative |
| 403 | 50 | 0.35 | $3.5 \times 10^5$ | 3.2 | Present Invention |
| 404 | 50 | 0.4 | $2.3 \times 10^5$ | 2.1 | Present Invention |
| 405 | 50 | 0.5 | $1.2 \times 10^5$ | 0.9 | Present Invention |
| 406 | 50 | 1.0 | $1.5 \times 10^5$ | 1.2 | Present Invention |
| 407 | 50 | 1.1 | $1.1 \times 10^4$ | 2.6 | Present Invention |
| 408 | 50 | 1.3 | $6.8 \times 10^3$ | 9.0 | Comparative |
| 409 | 50 | 1.5 | $4.4 \times 10^3$ | 15.5 | Comparative |
| 410 | 60 | 0.3 | $6.7 \times 10^5$ | 10.0 | Comparative |
| 411 | 60 | 0.35 | $4.2 \times 10^5$ | 7.1 | Comparative |
| 412 | 60 | 0.4 | $2.8 \times 10^5$ | 2.6 | Present Invention |
| 413 | 60 | 0.5 | $1.4 \times 10^5$ | 1.2 | Present Invention |
| 414 | 60 | 0.75 | $4.3 \times 10^4$ | 0.8 | Present Invention |
| 415 | 60 | 1.0 | $1.8 \times 10^4$ | 1.2 | Present Invention |
| 416 | 60 | 1.2 | $1.0 \times 10^4$ | 3.3 | Present Invention |

TABLE 5

| Sample No. | Slit Length Ls (in mm) | Slit Gap h (in mm) | Slit Pressure Loss ΔPs (in Pa) | Lateral Coating Thickness Fluctuation (in %) | Remarks |
|---|---|---|---|---|---|
| 417 | 60 | 1.3 | $8.2 \times 10^3$ | 8.5 | Comparative |
| 418 | 60 | 1.5 | $5.3 \times 10^3$ | 14.0 | Comparative |
| 419 | 75 | 0.3 | $8.3 \times 10^5$ | 9.9 | Comparative |
| 420 | 75 | 0.35 | $5.2 \times 10^5$ | 7.9 | Comparative |
| 421 | 75 | 0.4 | $3.5 \times 10^5$ | 2.5 | Present Invention |
| 422 | 75 | 0.5 | $1.8 \times 10^5$ | 1.1 | Present Invention |
| 423 | 75 | 0.75 | $5.3 \times 10^4$ | 0.7 | Present Invention |
| 424 | 75 | 1.0 | $2.3 \times 10^4$ | 1.2 | Present Invention |
| 425 | 75 | 1.3 | $1.0 \times 10^4$ | 3.5 | Present Invention |
| 426 | 75 | 1.5 | $6.7 \times 10^3$ | 11.5 | Comparative |
| 427 | 75 | 2.0 | $2.8 \times 10^3$ | 20.0 | Comparative |
| 428 | 100 | 0.3 | $1.1 \times 10^6$ | 12.0 | Comparative |
| 429 | 100 | 0.4 | $4.7 \times 10^5$ | 8.6 | Comparative |
| 430 | 100 | 0.45 | $3.3 \times 10^5$ | 2.3 | Present Invention |
| 431 | 100 | 0.5 | $2.4 \times 10^5$ | 1.3 | Present Invention |
| 432 | 100 | 0.75 | $7.1 \times 10^4$ | 0.9 | Present Invention |
| 433 | 100 | 1.0 | $3.0 \times 10^4$ | 1.5 | Present Invention |
| 434 | 100 | 1.4 | $1.1 \times 10^4$ | 3.3 | Present Invention |
| 435 | 100 | 1.5 | $8.9 \times 10^3$ | 10.0 | Comparative |
| 436 | 100 | 2.0 | $3.8 \times 10^3$ | 18.0 | Comparative |

In coating employing the extrusion coater having no back roller, when $\Delta Ps \leqq 4\times10^5$, the resultant lateral coating thickness fluctuation (in percent) became less than or equal to approximately 5 percent. Accordingly, it was possible to obtain excellent thickness distribution compared to the case of $\Delta Ps > 4\times10^5$, whereby the effects of the present invention were confirmed.

Example 5

The photosensitive layer coating liquid, employed in Example 1, was applied onto the belt-shaped support which was the same as in Example 1 at coating rate u of 1,000 mm/s so as to obtain pre-drying coating thickness hw (in mm) of 0.05 mm, employing a single layer slide coater described in FIG. 1 of Japanese Patent Application No. 2000-362590, while employing the coating system using a back roller described in FIG. 1 of Japanese Patent Application No. 2000-362590.

Coating was carried out varying slit pressure loss ΔPs (in Pa) by altering slit length Ls and slit gap h (in mm) of the employed slide coater, and subsequently, the resultant coating was dried, whereby Samples 501 through 536 shown in Tables 6 and 7 were prepared. Incidentally, the coating length of each sample was 1,000 m. The lateral coating thickness fluctuation (in percent) of each of Samples 501 through 536 was determined. Tables 6 and 7 show the results.

Incidentally, slit pressure loss ΔPs (in Pa) was determined employing the same method as in Example 1. Lateral coating thickness fluctuation (in percent) was determined employing the same method as in Example 1.

TABLE 6

| Sample No. | Slit Length Ls (in mm) | Slit Gap h (in mm) | Slit Pressure Loss ΔPs (in Pa) | Lateral Coating Thickness Fluctuation (in %) | Remarks |
|---|---|---|---|---|---|
| 501 | 50 | 0.25 | $9.6 \times 10^5$ | 9.5 | Comparative |
| 502 | 50 | 0.3 | $5.6 \times 10^5$ | 9.0 | Comparative |
| 503 | 50 | 0.35 | $3.5 \times 10^5$ | 3.9 | Present Invention |
| 504 | 50 | 0.4 | $2.3 \times 10^5$ | 3.0 | Present Invention |
| 505 | 50 | 0.5 | $1.2 \times 10^5$ | 1.5 | Present Invention |
| 506 | 50 | 1.0 | $1.5 \times 10^4$ | 1.9 | Present Invention |
| 507 | 50 | 1.1 | $1.1 \times 10^4$ | 3.0 | Present Invention |
| 508 | 50 | 1.2 | $8.7 \times 10^3$ | 9.5 | Comparative |
| 509 | 50 | 1.5 | $4.4 \times 10^3$ | 15.0 | Comparative |
| 510 | 60 | 0.3 | $6.7 \times 10^5$ | 9.0 | Comparative |
| 511 | 60 | 0.35 | $4.2 \times 10^5$ | 8.0 | Comparative |
| 512 | 60 | 0.4 | $2.8 \times 10^5$ | 3.5 | Present Invention |
| 513 | 60 | 0.5 | $1.4 \times 10^5$ | 2.6 | Present Invention |
| 514 | 60 | 0.75 | $4.3 \times 10^4$ | 1.4 | Present Invention |
| 515 | 60 | 1.0 | $1.8 \times 10^4$ | 2.0 | Present Invention |
| 516 | 60 | 1.2 | $1.0 \times 10^4$ | 3.1 | Present Invention |

TABLE 7

| Sample No. | Slit Length Ls (in mm) | Slit Gap h (in mm) | Slit Pressure Loss ΔPs (in Pa) | Lateral Coating Thickness Fluctuation (in %) | Remarks |
|---|---|---|---|---|---|
| 517 | 60 | 1.3 | $8.2 \times 10^3$ | 10.5 | Comparative |
| 518 | 60 | 1.5 | $5.3 \times 10^3$ | 17.0 | Comparative |
| 519 | 75 | 0.3 | $8.3 \times 10^5$ | 11.5 | Comparative |
| 520 | 75 | 0.35 | $5.2 \times 10^5$ | 8.6 | Comparative |
| 521 | 75 | 0.4 | $3.5 \times 10^5$ | 2.9 | Present Invention |
| 522 | 75 | 0.5 | $1.8 \times 10^5$ | 1.4 | Present Invention |
| 523 | 75 | 0.75 | $5.3 \times 10^4$ | 0.9 | Present Invention |
| 524 | 75 | 1.0 | $2.3 \times 10^4$ | 1.8 | Present Invention |
| 525 | 75 | 1.3 | $1.0 \times 10^4$ | 3.3 | Present Invention |
| 526 | 75 | 1.5 | $6.7 \times 10^3$ | 12.0 | Comparative |
| 527 | 75 | 2.0 | $2.8 \times 10^3$ | 19.5 | Comparative |
| 528 | 100 | 0.3 | $1.1 \times 10^6$ | 10.0 | Comparative |
| 529 | 100 | 0.4 | $4.7 \times 10^5$ | 8.8 | Comparative |
| 530 | 100 | 0.45 | $3.3 \times 10^5$ | 2.3 | Present Invention |
| 531 | 100 | 0.5 | $2.4 \times 10^5$ | 1.2 | Present Invention |
| 532 | 100 | 0.75 | $7.1 \times 10^4$ | 0.7 | Present Invention |
| 533 | 100 | 1.0 | $3.0 \times 10^4$ | 1.1 | Present Invention |
| 534 | 100 | 1.4 | $1.1 \times 10^4$ | 3.0 | Present Invention |
| 535 | 100 | 1.5 | $8.9 \times 10^3$ | 11.0 | Comparative |
| 536 | 100 | 2.0 | $3.8 \times 10^3$ | 17.0 | Comparative |

Even in slide coating, when $1\times10^4<\Delta Ps\leqq4\times10^5$, the resultant lateral coating thickness fluctuation (in percent) became less than or equal to approximately 4 percent. Accordingly, it was possible to obtain excellent thickness distribution compared to the case of $\Delta Ps>4\times10^5$, whereby the effects of the present invention were confirmed.

Example 6

The photosensitive layer coating liquid, employed in Example 1, was applied onto the belt-shaped support which was the same as in Example 1 at coating rate u (in mm/s) of 1,000 mm/s so as to obtain pre-drying coating thickness hw (in mm) of 0.05 mm, employing the curtain coater described in FIG. 2 of Japanese Patent Publication Open to Public Inspection No. 2000-225366, while employing the coating system using a back roller.

Coating was carried out varying slit pressure loss ΔPs (in Pa) by altering slit length Ls (in mm) and slit gap h (in mm) of the employed curtain coater, and subsequently, the resultant coating was dried, whereby Samples 601 through 636 shown in Tables 8 and 9 were prepared. Incidentally, the coating length of each sample was 1,000 m. The lateral coating thickness fluctuation (in percent) of each of Samples 601 through 636 was determined. Tables 6 and 7 show the results.

Incidentally, slit pressure loss ΔPs (in Pa) was determined employing the same method as in Example 1. Lateral coating thickness fluctuation (in percent) was determined employing the same method as in Example 1.

TABLE 8

| Sample No. | Slit Length Ls (in mm) | Slit Gap h (in mm) | Slit Pressure Loss ΔPs (in Pa) | Lateral Coating Thickness Fluctuation (in %) | Remarks |
|---|---|---|---|---|---|
| 601 | 50 | 0.25 | $9.6 \times 10^5$ | 15.0 | Comparative |
| 602 | 50 | 0.3 | $5.6 \times 10^5$ | 13.0 | Comparative |
| 603 | 50 | 0.35 | $3.5 \times 10^5$ | 5.0 | Present Invention |
| 604 | 50 | 0.4 | $2.3 \times 10^5$ | 3.5 | Present Invention |
| 605 | 50 | 0.5 | $1.2 \times 10^5$ | 2.8 | Present Invention |
| 606 | 50 | 0.75 | $3.6 \times 10^4$ | 3.3 | Present Invention |
| 607 | 50 | 1.0 | $1.5 \times 10^4$ | 4.5 | Present Invention |
| 608 | 50 | 1.2 | $8.7 \times 10^3$ | 16.0 | Comparative |
| 609 | 50 | 1.5 | $4.4 \times 10^3$ | 22.0 | Comparative |
| 610 | 60 | 0.3 | $6.7 \times 10^5$ | 11.0 | Comparative |
| 611 | 60 | 0.35 | $4.2 \times 10^5$ | 10.0 | Comparative |
| 612 | 60 | 0.4 | $2.8 \times 10^5$ | 4.6 | Present Invention |
| 613 | 60 | 0.5 | $1.4 \times 10^5$ | 3.2 | Present Invention |
| 614 | 60 | 0.75 | $4.3 \times 10^4$ | 2.5 | Present Invention |
| 615 | 60 | 1.0 | $1.8 \times 10^4$ | 3.0 | Present Invention |
| 616 | 60 | 1.2 | $1.0 \times 10^4$ | 5.0 | Present Invention |

TABLE 9

| Sample No. | Slit Length Ls (in mm) | Slit Gap h (in mm) | Slit Pressure Loss ΔPs (in Pa) | Lateral Coating Thickness Fluctuation (in %) | Remarks |
|---|---|---|---|---|---|
| 617 | 60 | 1.3 | $8.2 \times 10^3$ | 12.0 | Comparative |
| 618 | 60 | 1.5 | $5.3 \times 10^3$ | 20.0 | Comparative |
| 619 | 75 | 0.3 | $8.3 \times 10^5$ | 14.0 | Comparative |
| 620 | 75 | 0.35 | $5.2 \times 10^5$ | 11.0 | Comparative |

TABLE 9-continued

| Sample No. | Slit Length Ls (in mm) | Slit Gap h (in mm) | Slit Pressure Loss ΔPs (in Pa) | Lateral Coating Thickness Fluctuation (in %) | Remarks |
|---|---|---|---|---|---|
| 621 | 75 | 0.4 | $3.5 \times 10^5$ | 4.1 | Present Invention |
| 622 | 75 | 0.5 | $1.8 \times 10^5$ | 2.9 | Present Invention |
| 623 | 75 | 0.75 | $5.3 \times 10^4$ | 2.1 | Present Invention |
| 624 | 75 | 1.0 | $2.3 \times 10^4$ | 3.0 | Present Invention |
| 625 | 75 | 1.3 | $1.0 \times 10^4$ | 4.8 | Present Invention |
| 626 | 75 | 1.4 | $8.2 \times 10^3$ | 12.5 | Comparative |
| 627 | 75 | 1.5 | $6.7 \times 10^3$ | 15.0 | Comparative |
| 628 | 100 | 0.3 | $1.1 \times 10^6$ | 16.0 | Comparative |
| 629 | 100 | 0.4 | $4.7 \times 10^5$ | 12.0 | Comparative |
| 630 | 100 | 0.45 | $3.3 \times 10^5$ | 4.1 | Present Invention |
| 631 | 100 | 0.5 | $2.4 \times 10^5$ | 2.8 | Present Invention |
| 632 | 100 | 0.75 | $7.1 \times 10^4$ | 1.4 | Present Invention |
| 633 | 100 | 1.0 | $3.0 \times 10^4$ | 2.3 | Present Invention |
| 634 | 100 | 1.4 | $1.1 \times 10^4$ | 4.0 | Present Invention |
| 635 | 100 | 1.5 | $8.9 \times 10^3$ | 12.0 | Comparative |
| 636 | 100 | 2.0 | $3.8 \times 10^3$ | 20.0 | Comparative |

Even in curtain coating, when $1\times10^4<\Delta Ps\leqq4\times10^5$, the resultant lateral coating thickness fluctuation (in percent) became less than or equal to approximately 5 percent. Accordingly, it was possible to obtain excellent thickness distribution compared to the case of $\Delta Ps>4\times10^5$, whereby the effects of the present invention were confirmed.

Example 7

The photosensitive layer coating liquid, employed in Example 1, was applied onto the belt-shaped support which was the same as in Example 1 at coating rate u (in mm/s) of 1,000 mm/s, employing a single layer extrusion coater having slit length Ls (in mm), while employing the same coating system as in Example 1.

Coating was carried out varying the supply amount of said photosensitive layer coating liquid, slit gap h (in mm) of the single layer extrusion coater employed, and difference Δh (in mm) between the maximum value and the minimum value of its fluctuation so as to vary post-drying coating thickness hd (in mm) as well as permissible maximum value $\Delta hd_{max}$ (in mm) of the difference between the maximum value and the minimum value of its fluctuation, and subsequently, the resultant coating was dried, whereby Samples 701 through 716 shown in Table 10 were prepared. Incidentally, the coating length of each sample was 1,000 m.

Difference Δhd (in mm) between the maximum value and the minimum value of fluctuation of lateral post-drying coating thickness was measured. Employing the measurement results, difference Δhd (in mm) between the maximum value and the minimum value of fluctuation of lateral post-drying coating thickness was compared to permissible maximum value $\Delta hd_{max}$ (in mm) of the difference between the maximum value and the minimum value of fluctuation of lateral coating thickness. Table 10 shows the results.

Said difference Δhd (in mm) between the maximum value and the minimum value of fluctuation of lateral post-drying coating thickness was determined as follows. The thickness including the support of each sample was measured at 18 positions at an interval of 50 mm of the full coating width located 10 m from the end of the coating. Thereafter, the surface of coating at each measured position was damped with methyl ethyl ketone and then peeled off, employing unwoven fabric, and only the thickness of the belt-shaped support was determined. The difference between the measured values was designated as thickness of the coating.

The coating thickness was determined employing a contact type layer thickness meter (Denki Micrometer Minicom M, manufactured by Tokyo Seimitsu Co.

Difference Δh (in mm) between the maximum value and the minimum value of fluctuation of slit gap h (in mm) was determined as described below. A thickness gauge, which has thickness difference by 0.001 mm, was inserted into a slit and the maximum thickness, which was capable of being inserted, was regarded as slit gap h (in mm) at the inserted position. Said measurement was carried out at 11 positions at an interval of 100 mm in the lateral direction of the coating. Subsequently, the difference between the maximum value and the minimum value was designated as Δh (in mm). Incidentally, based on the degree of resistance during insertion, the minimum unit of said slit gap was determined to be 0.0005 mm.

TABLE 10

| Sample No. | Coating Thickness (in mm) | Permissible Maximum Value $\Delta hd_{max}$ (in mm) of Difference between Maximum Value and Minimum Value of Fluctuation of Lateral Coating Thickness (in mm) | Slit Gap h (in mm) | Difference Δh (in mm) between Maximum Value and Minimum Value of Fluctuation of Slit Gap h | $h \times (\Delta hd_{max}/hd)/\Delta h$ | Difference Δhd (in mm) between Maximum Value and Minimum Value of Fluctuation of Lateral Coating Thickness | Remarks |
|---|---|---|---|---|---|---|---|
| 701 | 0.025 | 0.0005 | 0.5 | 0.0025 | 4.0 | 0.00038 | Inv. |
| 702 | 0.025 | 0.0005 | 0.5 | 0.003 | 3.3 | 0.00048 | Inv. |
| 703 | 0.025 | 0.0005 | 0.5 | 0.0035 | 2.9 | 0.00063 | Comp. |
| 704 | 0.025 | 0.0005 | 0.5 | 0.004 | 2.5 | 0.00075 | Comp. |
| 705 | 0.025 | 0.0005 | 0.3 | 0.0015 | 4.0 | 0.00040 | Inv. |
| 706 | 0.025 | 0.0005 | 0.3 | 0.002 | 3.0 | 0.00050 | Inv. |
| 707 | 0.025 | 0.0005 | 0.3 | 0.0025 | 2.4 | 0.00070 | Comp. |
| 708 | 0.025 | 0.0005 | 0.3 | 0.003 | 2.0 | 0.00080 | Comp. |
| 709 | 0.04 | 0.0008 | 0.75 | 0.004 | 3.8 | 0.00060 | Inv. |
| 710 | 0.04 | 0.0008 | 0.75 | 0.005 | 3.0 | 0.00076 | Inv. |

TABLE 10-continued

| Sample No. | Coating Thickness (in mm) | Permissible Maximum Value $\Delta hd_{max}$ (in mm) of Difference between Maximum Value and Minimum Value of Fluctuation of Lateral Coating Thickness (in mm) | Slit Gap h (in mm) | Difference Δh (in mm) between Maximum Value and Minimum Value of Fluctuation of Slit Gap h | h × ($\Delta hd_{max}$/hd)/Δh | Difference Δhd (in mm) between Maximum Value and Minimum Value of Fluctuation of Lateral Coating Thickness | Remarks |
|---|---|---|---|---|---|---|---|
| 711 | 0.04 | 0.0008 | 0.75 | 0.006 | 2.5 | 0.00100 | Comp. |
| 712 | 0.04 | 0.0008 | 0.75 | 0.007 | 2.1 | 0.00120 | Comp. |
| 713 | 0.04 | 0.0008 | 0.5 | 0.002 | 5.0 | 0.00064 | Inv. |
| 714 | 0.04 | 0.0008 | 0.5 | 0.003 | 3.3 | 0.00080 | Inv. |
| 715 | 0.04 | 0.0008 | 0.5 | 0.004 | 2.5 | 0.00112 | Comp. |
| 716 | 0.04 | 0.0008 | 0.5 | 0.005 | 2.0 | 0.00128 | Comp. |

Inv.: Present Invention, Comp.: Comparative

When $3 \leqq h \times (\Delta hd_{max}/hd)/\Delta h$, namely $\Delta h \leqq h \times (\Delta hd_{max}/hd)/3$ was satisfied, as desired, difference Δhd (in mm) between the maximum value and the minimum value of fluctuation of the lateral coating thickness after coating became less than permissible maximum value $\Delta hd_{max}$ (in mm), whereby the effects of the present invention were confirmed.

Example 8

The photosensitive layer coating liquid, employed in Example 1, was applied onto the belt-shaped support which was the same as in Example 1 at coating rate u (in mm/s) of 1,000 mm/s so as to obtain post-drying coating thickness hd (in mm) of 0.05 mm and permissible maximum value $\Delta hd_{max}$ (in mm) of Δhd (in mm) between the maximum value and the minimum value of fluctuation of the lateral post-drying coating thickness of 0.001 mm, employing a single layer extrusion coater having slit length Ls (in mm) of 50 mm and lateral coating distance X (in mm), which was furthest from the coating liquid supply port of the pocket, of 500 mm, while employing the same coating system as in Example 1.

Coating was carried out employing various equivalent radius R (in mm) of the pocket while setting slit gap h (in mm) at 0.5 mm or 0.75 mm, whereby Samples 801 through 810 shown in Table 11 were prepared. Incidentally, the coating length of each sample was 1,000 m. Difference Δhd (in mm) between the maximum value and the minimum value of fluctuation of the lateral post-drying coating thickness of each of Samples 801 through 810 was determined. Subsequently, A coater head shape, in which difference Δhd (in mm) between the maximum value and the minimum value of fluctuation of the lateral post-drying coating thickness was less than permissible maximum coating thickness difference $\Delta hd_{max}$ (in mm), was surveyed. Table 11 shows the results in which the resultant shape is compared to the permissible coating layer thickness distribution $\Delta hd_{max}$/hd value.

Further, employing the same single layer extrusion coater and belt-shaped support as in Example 4, the magnetic layer coating liquid, described below, was applied onto said belt-shaped support at coating rate u (in mm/s) of 10,000 mm/s so as to obtain post-drying coating thickness hd (in mm) of 0.0017 mm and permissible maximum value $\Delta hd_{max}$ (in mm) of difference Δhd between the maximum value and the minimum value of fluctuation of the lateral post-drying coating thickness of 0.0001 mm, while employing the coating system shown in FIG. 1(*b*) which did not use the back roller.

Said coating was carried out employing various equivalent radius R (in mm) of the pocket while setting slit gap h (in mm) at 0.75 mm or 1.00 mm, whereby Samples 811 through 820 shown in Table 11 were prepared. Difference Δhd (in mm) between the maximum value and the minimum value of fluctuation of the lateral post-drying coating thickness of each of Samples 811 through 820 was determined. Subsequently, A coater head shape, in which difference Δhd (in mm) between the maximum value and the minimum value of fluctuation of the lateral coating thickness after coating was less than permissible maximum coating thickness difference $\Delta hd_{max}$ (in mm), was surveyed. Table 11 shows the results in which the resultant shape is compared to the permissible coating layer thickness distribution $\Delta hd_{max}$/hd value.

The aforesaid coating thickness was determined as follows. The thickness, including a belt-shaped support, of one position of each sample was determined. Subsequently, the coating layer at the same position was peeled off employing unwoven fabric damped with methyl ethyl ketone, and the thickness of the belt-shaped support was determined. The difference between determined values was designated as the thickness of only the coating layer. Difference Δhd (in mm) between the maximum value and the minimum value of fluctuation of coating thickness was determined as follows. Said coating thickness was determined at 18 positions at an interval of 50 mm of the full coating width located 10 m from the end of the coating. Subsequently, the difference between the maximum value and the minimum value was obtained and designated as difference Δhd. Said coating thickness was measured employing a high precision digital footage counter (Nanoacs, manufactured by Tokyo Seimitsu Co.).

A thickness gauge, which had thickness difference by 0.01 mm, was inserted into a slit and the maximum thickness, which was capable of being inserted, was designated as slit gap h.

| <Magnetic Layer Coating Liquid> | |
|---|---|
| Ferromagnetic metal powder (having Hc of 2350 Oe, σs 155 emu/g, an average long axis length of 0.1 μm, and a specific surface area of 50 $m^2/g$) | 100 parts |
| Vinyl chloride polymer (Mr110 having a degree of polymerization of 300, manufactured by Nippon Zeon Co.) | 10 parts |
| Polyurethane (UR8300, manufactured by Toyobo Co.) | 5 parts |
| Carbon black (Conductex 975, manufactured by Columbia Carbon Co.) | 1 part |
| Alumina (HIT50, manufactured by Sumitomo Kagaku Co.) | 10 parts |
| Minute diamond powder having an average particle diameter of 0.3 μm | 1 part |
| Phenylphosphonic acid | 3 parts |
| Butyl stearate | 10 parts |
| Butoxyethyl stearate | 5 parts |
| Isohexadecyl stearate | 3 parts |
| Stearic acid | 2 parts |
| Methyl ethyl ketone | 180 parts |
| Cyclohexanone | 180 parts |

was the same as in Example 1 at coating rate u (in mm/s) of 1,000 mm/s so as to obtain pre-drying coating thickness hw (in mm) of 0.14 mm and permissible maximum value $\Delta hd_{max}$ (in mm) of Δhd (in mm) between the maximum value and the minimum value of fluctuation of the lateral post-drying coating thickness of the coating having a post-drying coating thickness of 0.05 mm of 0.001 mm. Incidentally, coating was carried out at slit gap h (in mm) of 0.5 mm and Young modulus E (in Pa) of the coater member of $200\times10^9$ Pa, varying slit length Ls (in mm), length Lp of the pocket cross-section along the slit, thickness $t_1$ (in mm) of the thinnest portion of the pocket of the upstream side bar, and thickness $t_2$ (in mm) of the thinnest portion of the pocket of the downstream side bar, whereby Samples 901 through 932, shown in Table 12, were prepared. Incidentally, the coating length of each sample was 1,000 m. Difference Δhd (in mm) between the maximum value and the minimum value of fluctuation of the lateral post-drying coating thickness of each of Samples 901 through 932 was determined. Subsequently, A coater head shape, in which difference Δhd (in mm) between the maximum value and the minimum value of fluctuation of the lateral post-drying coating thickness was less than or equal to permissible maximum coating thickness difference $\Delta hd_{max}$ (in mm), was surveyed. Table 12 shows the results in which the resultant shape is compared to the permissible coating layer thickness distribution $\Delta hd_{max}$/hd value.

TABLE 11

| Sample No. | Slit Gap h (in mm) | Coater Pocket Radius R (in mm) | Difference Δhd (in mm) between Maximum Value and Minimum Value of Fluctuation of Lateral Coating Thickness | $(L^2/R^4)/(Ls/h^3)$ | 18 × (Δhd/hd) | Remarks |
|---|---|---|---|---|---|---|
| 801 | 0.5 | 5.0 | 0.0150 | 1.000 | 0.360 | Comp. |
| 802 | 0.5 | 6.0 | 0.0012 | 0.482 | 0.360 | Comp. |
| 803 | 0.5 | 7.0 | 0.0010 | 0.260 | 0.360 | Inv. |
| 804 | 0.5 | 8.0 | 0.0008 | 0.153 | 0.360 | Inv. |
| 805 | 0.5 | 10.0 | 0.0005 | 0.063 | 0.360 | Inv. |
| 806 | 0.75 | 7.0 | 0.0090 | 0.879 | 0.360 | Comp . |
| 807 | 0.75 | 8.0 | 0.0025 | 0.515 | 0.360 | Comp. |
| 808 | 0.75 | 9.0 | 0.0010 | 0.322 | 0.360 | Inv. |
| 809 | 0.75 | 10.0 | 0.0008 | 0.211 | 0.360 | Inv. |
| 810 | 0.75 | 12.5 | 0.0004 | 0.086 | 0.360 | Inv. |
| 811 | 0.75 | 5.0 | 0.00041 | 3.375 | 1.059 | Comp. |
| 812 | 0.75 | 6.0 | 0.00015 | 1.628 | 1.059 | Comp. |
| 813 | 0.75 | 7.0 | 0.00010 | 0.879 | 1.059 | Inv. |
| 814 | 0.75 | 8.0 | 0.00008 | 0.515 | 1.059 | Inv. |
| 815 | 0.75 | 10.0 | 0.00005 | 0.211 | 1.059 | Inv. |
| 816 | 1.0 | 7.0 | 0.00030 | 2.082 | 1.059 | Comp. |
| 817 | 1.0 | 8.0 | 0.00012 | 1.221 | 1.059 | Comp. |
| 818 | 1.0 | 9.0 | 0.00009 | 0.762 | 1.059 | Inv. |
| 819 | 1.0 | 10.0 | 0.00007 | 0.500 | 1.059 | Inv. |
| 820 | 1.0 | 12.5 | 0.00005 | 0.205 | 1.059 | Inv. |

Inv.: Present Invention, Comp.: Comparative

Irrespective of coating systems, when $(L^2/R^4)/(Ls/h^3) < 18\times(\Delta hd/hd)$ was satisfied, it was possible to make difference Δhd (in mm) between the maximum value and the minimum value of fluctuation of the lateral post-drying thickness of the coating less than or equal to maximum permissible $\Delta hd_{max}$ (in mm), whereby the desired coating was carried out.

Example 9

The photosensitive layer coating liquid, employed in Example 1, was applied onto the belt-shaped support which Difference Δhd (in mm) between the maximum value and the minimum value of fluctuation of the lateral post-drying coating thickness was determined employing the same method as in Example 7.

TABLE 12

| Sample No. | Ls (in mm) | Lp (in mm) | $t_1$ (in mm) | $t_2$ (in mm) | Difference Δhd (in mm) between Maximum Value and Minimum Value of Fluctuation of Lateral Coating Thickness | $6(t_1^{-3} + t_2^{-3})\mu hw uLs (Ls/2 + Lp) L^3/h^4E$ | Δhd/hd | Remarks |
|---|---|---|---|---|---|---|---|---|
| 901 | 50 | 20 | 10.0 | 10.0 | 0.0032 | 0.052 | 0.020 | Comp. |
| 902 | 50 | 20 | 12.5 | 12.5 | 0.0017 | 0.027 | 0.020 | Comp. |
| 903 | 50 | 20 | 15.0 | 15.0 | 0.0007 | 0.015 | 0.020 | Inv. |
| 904 | 50 | 20 | 17.5 | 17.5 | 0.0005 | 0.010 | 0.020 | Inv. |
| 905 | 50 | 30 | 12.5 | 12.5 | 0.0050 | 0.048 | 0.020 | Comp. |
| 906 | 50 | 30 | 15.0 | 15.0 | 0.0015 | 0.028 | 0.020 | Comp. |
| 907 | 50 | 30 | 17.5 | 17.5 | 0.0008 | 0.018 | 0.020 | Inv. |
| 908 | 50 | 30 | 20.0 | 20.0 | 0.0006 | 0.012 | 0.020 | Inv. |
| 909 | 60 | 30 | 17.5 | 17.5 | 0.0030 | 0.033 | 0.020 | Comp. |
| 910 | 60 | 30 | 20.0 | 20.0 | 0.0020 | 0.022 | 0.020 | Comp. |
| 911 | 60 | 30 | 22.5 | 22.5 | 0.0008 | 0.015 | 0.020 | Inv. |
| 912 | 60 | 30 | 25.0 | 25.0 | 0.0005 | 0.011 | 0.020 | Inv. |
| 913 | 60 | 40 | 17.5 | 17.5 | 0.0034 | 0.053 | 0.020 | Comp. |
| 914 | 60 | 40 | 20.0 | 20.0 | 0.0015 | 0.035 | 0.020 | Comp. |
| 915 | 60 | 40 | 25.0 | 25.0 | 0.0009 | 0.018 | 0.020 | Inv. |
| 916 | 60 | 40 | 30.0 | 30.0 | 0.0006 | 0.010 | 0.020 | Inv. |
| 918 | 75 | 40 | 25.0 | 25.0 | 0.0030 | 0.038 | 0.020 | Comp. |
| 918 | 75 | 40 | 30.0 | 30.0 | 0.0020 | 0.022 | 0.020 | Comp. |
| 919 | 75 | 40 | 35.0 | 35.0 | 0.0008 | 0.014 | 0.020 | Inv. |
| 920 | 75 | 40 | 40.0 | 40.0 | 0.0005 | 0.009 | 0.020 | Inv. |
| 921 | 75 | 50 | 25.0 | 25.0 | 0.0034 | 0.055 | 0.020 | Comp. |
| 922 | 75 | 50 | 30.0 | 30.0 | 0.0015 | 0.032 | 0.020 | Comp. |
| 923 | 75 | 50 | 35.0 | 35.0 | 0.0010 | 0.020 | 0.020 | Inv. |
| 924 | 75 | 50 | 40.0 | 40.0 | 0.0007 | 0.013 | 0.020 | Inv. |
| 925 | 100 | 50 | 40.0 | 40.0 | 0.0038 | 0.035 | 0.020 | Comp. |
| 926 | 100 | 50 | 45.0 | 45.0 | 0.0025 | 0.025 | 0.020 | Comp. |
| 927 | 100 | 50 | 50.0 | 50.0 | 0.0009 | 0.018 | 0.020 | Inv. |
| 928 | 100 | 50 | 55.0 | 55.0 | 0.0007 | 0.014 | 0.020 | Inv. |
| 929 | 100 | 60 | 45.0 | 45.0 | 0.0055 | 0.033 | 0.020 | Comp. |
| 930 | 100 | 60 | 50.0 | 50.0 | 0.0035 | 0.024 | 0.020 | Comp. |
| 931 | 100 | 60 | 55.0 | 55.0 | 0.0009 | 0.018 | 0.020 | Inv. |
| 932 | 100 | 60 | 60.0 | 60.0 | 0.0006 | 0.014 | 0.020 | Inv. |

Inv.: Present Invention, Comp.: Comparative

Incidentally, in Table 12, Ls represents the slit length; Lp represents the length of the cross-section of the pocket along the silt length; $t_1$ represents the thickness of thinnest portion of the pocket section in the upstream side block; and $t_2$ represents the thickness of thinnest portion of the pocket section in the downstream side block.

Based on Table 12, when $6(t_1^{-3}+t_2^{-3})\mu\times hw\times u\times Ls(Ls/2+Lp)L^3/(h^4E)\leqq\Delta hd/hd$ was satisfied, it was possible to make difference Δhd (in mm) between the maximum value and the minimum value of fluctuation of the lateral post-drying coating thickness less than or equal to maximum permissible Δhd=0.001 mm, whereby the desired effects were obtained.

In coating employing a coater having a pocket as well as a slit, it is possible to provide an optimal coating apparatus as well as an optimal coating method which matches liquid physical properties of a coating liquid to be coated and coating conditions in order to minimize fluctuation of the lateral coating thickness, whereby it becomes to possible to carry out coating which minimizes fluctuation of the lateral coating thickness without performing trial and error operations such as the mechanical adjustment of the slit gap, as well as the alteration of coating conditions.

What is claimed is:

1. A coating method of coating a coating liquid on a web-shaped support with a coater having at least one set of a slit and a pocket, comprising steps of:

feeding the coating liquid having a viscosity $\mu$ (Pa·s) to the coater in which the slit has a length Ls (mm), a gap h (mm);

conveying the web-shaped support at a coating speed u (mm/s);

coating the coating liquid on the conveyed web-shaped support with the coater so as to form at least one coating layer having a pre-dried layer thickness hw (mm) and a dried layer thickness hd;

setting and adjusting slit length Ls, slit gap h, viscosity $\mu$, pre-dried layer thickness hw, and coating speed u to satisfy the following conditional formula $$1\times10^4<12\times\mu\times Ls\times hw\times u/h^3\leqq4\times10^5;\text{ and}$$

setting a difference between the maximum value and the minimum value in dispersion of the gap of the slit Δh measured along the entire length of the slit to satisfy the following conditional formula:

$$\Delta h\leqq h\times(\Delta hd_{max}/hd)3$$

wherein $\Delta hd_{max}$ is a permissible maximum value (mm) among differences Δhd (mm) between the maximum value and the minimum value in the dispersion of a dried layer thickness hd (mm) measured along the entire width of the coating layer.

2. The coating apparatus of claim 1, wherein the following conditional formula is satisfied:

$$(X^2/R^4)/(Ls/h^3)<18\times(\Delta hd_{max}/hd)$$

where R is a corresponding radius (mm) of the pocket,

X is a length (mm) of the pocket at a position farthest from the a coating liquid feeding port, and $\Delta hd_{max}$ is a permissible maximum value (mm) among differences Δhd (mm) between the maximum value and the minimum value in the dispersion of a dried layer thickness hd measured along the entire width of the coating layer.

3. The coating method of claim 1, wherein the following conditional formula is satisfied:

$$6(t_1^{-3}+t_2^{-3})\mu\times hw\times u\times Ls(Ls/2+Lp)L^3/(h^4E)\leqq\Delta hd_{max}/hd$$

where Lp is a length (mm) of a cross section of the pocket in the direction corresponding to the length of the slit, L (mm)=Ls (mm)+Lp (mm), E is a Young's modulus (Pa) of a coater member, t1 is a thickness (mm) of the thinnest portion of the pocket of the bar on the upstream side, t2 is a thickness (mm) of the thinnest portion of the pocket of the bar on the downstream side, and $\Delta hd_{max}$ is a permissible maximum value (mm) among differences Δhd (mm) between the maximum value and the minimum value in the dispersion of a dried layer thickness hd measured along the entire width of the coating layer.

4. The coating method of claim 1, wherein the coater is a multi-layer coater which coats n-layers more than at least two layers and has at least two sets of slits and pockets and the following conditional formula is satisfied:

$$6(t_i^{-3}+t_{i+1}^{-3})\mu_i\times hw_i\times u\times L_{si}$$

$$(L_{si}/2+Lp_i)\,L_i^3/h_i^3-6t_i^{-3}$$

$$\times\mu_{i-1}\times hw_{i-1}\times u\times Ls_{i-1}$$

$$(Ls_{i-1}/2+Lp_{i-1})L_{i-1}^3/h_{i-1}^3$$

$$-6t_{i+1}^{-3}\times\mu_{i+1}\times$$

$$hw_{i+1}\times u\times Ls_{i+1}(Ls_{i+1}/2+Lp_{i+1})$$

$$L_{i+1}^3/h_{i+1}^3\leqq h_i$$

$$(\Delta hd_{maxi}/hd_i)E$$

where $Ls_1, Ls_2, \ldots, Ls_{i-1}, Ls_i, Ls_{i+1} \ldots, Ls_n$ represent the length Ls (mm) of each slit in sequential order from the upstream side, $Lp_1, Lp_2, \ldots, Lp_{i-1}, Lp_i, Lp_{i+1} \ldots, Lp_n$ represent the length Lp (mm) of the cross section of each pocket in the direction corresponding to the length of the slit in sequential order from the upstream side, $L_1, L_2, \ldots, L_{i-1}, L_i, L_{i+1} \ldots, L_n$ represent the sum L (mm) of Ls of each slit and Lp of each pocket in sequential order from the upstream side, E is a Young's modulus (Pa) of a coater member, $t_1, t_2, t_3, \ldots, t_{i-1}, t_i, t_{i+1} \ldots, t_n$ represent a thickness t1 of the thinnest portion of the pocket of each bar in sequential order from the block located at the most upstream side, $\mu_i$ represents a viscosity (Pa·s) of a coating liquid having the order of $i^{th}$ from upstream side, $hw_i$ is a pre-dried coating layer thickness (mm) of a coating layer having the order of $i^{th}$ from upstream side, $hd_i$ is a dried coating layer thickness (mm) of a coating layer having the order of $i^{th}$ from upstream side, and $\Delta hd_{maxi}$ is a permissible maximum value $\Delta hd_{max}$ (mm) among differences between the maximum value and the minimum value in the dispersion of a dried layer thickness of a coating layer having the order of $i^{th}$ from the upstream side.

5. The coating method of claim 1, further comprising:

supporting a side of the web-shaped support opposite to the coated side with a back roll.

6. The coating method of claim 1, wherein the viscosity of the coating liquid is 0.05 to 10 (Pa·s).

7. The coating method of claim 1, wherein the viscosity of the coating liquid is 0.1 to 5 (Pa·s).

8. The coating method of claim 1, wherein a coating width of the slit is 1000 mm to 1500 mm.

* * * * *